US009753425B2

(12) United States Patent
Kowase

(10) Patent No.: US 9,753,425 B2
(45) Date of Patent: Sep. 5, 2017

(54) SHEET CONVEYANCE DEVICE AND IMAGE FORMING SYSTEM EQUIPPED WITH THE SAME

(71) Applicant: KONICA MINOLTA, INC., Chiyoda-ku, Tokyo (JP)

(72) Inventor: Kazuhiko Kowase, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/137,496

(22) Filed: Apr. 25, 2016

(65) Prior Publication Data

US 2016/0334751 A1 Nov. 17, 2016

(30) Foreign Application Priority Data

May 11, 2015 (JP) ..... 2015-096408

(51) Int. Cl.
*G03G 15/00* (2006.01)
*B65H 85/00* (2006.01)
(Continued)

(52) U.S. Cl.
CPC ..... *G03G 15/70* (2013.01); *B65H 5/26* (2013.01); *B65H 7/06* (2013.01); *B65H 29/125* (2013.01); *B65H 43/04* (2013.01); *B65H 85/00* (2013.01); *G03G 15/5012* (2013.01); *B65H 2301/33312* (2013.01); *B65H 2402/10* (2013.01); *B65H 2403/942* (2013.01); *B65H 2404/632* (2013.01);
(Continued)

(58) Field of Classification Search
CPC .... G03G 15/70; G03G 15/5012; B65H 85/00; B65H 5/26; B65H 7/06; B65H 2301/33312; B65H 2511/528; B65H 2513/43; B65H 2513/51; B65H 2801/27; B65H 29/125; B65H 43/04; B65H 2402/10; B65H 2403/942; B65H 2404/632
See application file for complete search history.

(56) References Cited

U.S. PATENT DOCUMENTS 5,172,162 A * 12/1992 Taneda ..... B65H 29/60 270/58.14
7,883,087 B2 2/2011 Kitano
(Continued)

FOREIGN PATENT DOCUMENTS

JP 09124208 A * 5/1997
JP 2005221518 A 8/2005
(Continued)

*Primary Examiner* — David Banh
(74) *Attorney, Agent, or Firm* — Holtz, Holtz & Volek PC

(57) ABSTRACT

When a jam is detected in a post-processing device, a purge controller first makes a conveyance roller group and a reverse roller continue conveyance. The purge controller then sets the conveyance destination of a leading sheet that will first arrive at a branch point after the time of detection of the jam. When a first condition is satisfied the purge controller sets the conveyance destination to a reverse slot, and when a second condition is satisfied the purge controller sets the conveyance destination to an outlet path. The first condition is satisfied when no other sheet is present in the reverse slot at the time of detection of the jam, and the second condition is satisfied when another sheet is present in the reverse slot at the time of detection of the jam.

16 Claims, 14 Drawing Sheets

(51) Int. Cl.

| | |
|---|---|
| ***B65H 5/26*** | (2006.01) |
| ***B65H 7/06*** | (2006.01) |
| ***B65H 29/12*** | (2006.01) |
| ***B65H 43/04*** | (2006.01) |

(52) U.S. Cl.
CPC .... *B65H 2511/528* (2013.01); *B65H 2513/42* (2013.01); *B65H 2513/51* (2013.01); *B65H 2801/27* (2013.01)

(56) References Cited

U.S. PATENT DOCUMENTS

| | | | | |
|---|---|---|---|---|
| 8,417,176 | B2 * | 4/2013 | Shoji | G03G 15/6579 271/184 |
| 8,960,672 | B2 * | 2/2015 | Takenaka | B65H 43/02 271/256 |
| 8,960,673 | B2 * | 2/2015 | Yoshida | B65H 29/125 271/225 |
| 9,096,398 | B2 * | 8/2015 | Nakagaki | B65H 7/125 |
| 2012/0155943 | A1 * | 6/2012 | Taki | G03G 15/234 399/401 |
| 2014/0183811 | A1 * | 7/2014 | Takenaka | B65H 43/02 271/3.19 |
| 2016/0318728 | A1 * | 11/2016 | Kowase | B65H 29/60 |
| 2016/0318731 | A1 * | 11/2016 | Kowase | B65H 43/04 |

FOREIGN PATENT DOCUMENTS

| | | | |
|---|---|---|---|
| JP | 2013242362 | A | 12/2013 |
| JP | 2014119634 | A | 6/2014 |

* cited by examiner

SHEET CONVEYANCE DEVICE AND IMAGE FORMING SYSTEM EQUIPPED WITH THE SAME

This application is based on an application No. 2015-096408 filed in Japan, the contents of which are hereby incorporated by reference.

BACKGROUND OF THE INVENTION

1. Field of the Invention

The invention relates to technologies of conveying a sheet, and in particular to technologies of purging it.

2. Background

Typically, sheet conveyance devices built into image forming devices, such as printers and copiers, sheet feeder devices, or post-processing devices, convey sheets consecutively along a single path to allow sequential processing, such as printing, to be performed with respect to the sheets, thus achieving high-speed processing of several dozen pages per minute (ppm) or more.

If a failure such as a paper jam or a defect in image quality occurs with respect to a sheet conveyed through the path, a sheet conveyance device usually forces other conveyed sheets to stop at appropriate locations on the path. See for example JP 2005-221518. Removal from the path of all the sheets that the device stops is required to make the device resume conveying other sheets. However, leaving all removal to a user is a burden on the user.

Conventional sheet conveyance devices include a type that automatically discharges a conveyed sheet if an image forming device or the like aborts processing the sheet. Hereinafter, such discharging of a sheet is referred to as "purging", and in particular discharging upon detection of a cause of a processing abortion such as a paper jam is referred to as "pre-purging". A sheet to be purged is generally purged to a dedicated tray that is different from an output tray originally intended as a destination of conveyance. See for example JP 2014-119634.

SUMMARY OF THE INVENTION

Usage of such sheet conveyance devices is limited to larger-sized image forming systems such as production printers (PPs) since the devices require the systems to reserve space for sheet purging. However, higher speed and functionality of recent medium- and small-sized image forming systems such as office printers (OPs) has caused a demand to implement the purging function into sheet conveyance devices to be built into such systems.

On the other hand, there is still a strong demand to reduce medium- and small-sized image forming systems in size and height. To implement the purging function into the sheet conveyance devices to be built in such systems thus requires a design enabling an existing place where sheets are to be ejected to double as a place where sheets can be purged.

The outside of a reverse slot in a medium- or small-sized image forming system is one of the viable places to which sheets can be purged. The "reverse slot" is an opening of the body of the sheet conveyance device, where a sheet that should reverse its direction of motion partially hangs out to be exposed on the outside of the body and then moves in the reverse direction. In contrast to the large-sized system such as a PP, the medium- or small-sized system such as an OP allows the sheet while reversing its direction of motion to hang out of the body so that it can reduce the volume of a space required for the reversing of the sheet. Accordingly, a design to enable the outside of the reverse slot to double as a place in which sheets to be purged could allow the purging function to be implemented in a sheet conveyance device while maintaining reduced size of the image forming system.

To enable the reverse slot to double as the destination of sheets to be purged requires the system to reliably protect a sheet to be purged from coming into contact with another sheet that is reversing its direction of motion at the reverse slot. Indeed, such contact can occur even during normal duplex printing because of unavoidable errors in detected location of a sheet being conveyed. See for example JP 2013-242362. In addition, spacing between sheets conveyed during duplex printing can generally take either of two values: a first value when consecutive sheets have the first sides to be printed; and a second value when a sheet with the second side to be printed follows another sheet with the first side to be printed. The second value is normally shorter than the first one for the purpose of higher productivity. Thus, when a sheet to be first purged is a sheet with the second side to be printed following another sheet with the first side to be printed, there is a higher risk of the sheet to be first purged coming into contact with the other sheet that is reversing its direction of motion at the reverse slot.

An object of the invention is to solve the above-discussed technical problems and, in particular, to provide a sheet conveyance device capable of purging a sheet through the reverse slot without causing the sheet to come into contact with another sheet that is reversing its direction of motion at the reverse slot.

A sheet conveyance device according to one aspect of the invention includes a body, a conveyance unit, a switching unit, a delivery unit, a reverse unit, a return unit, and a controller unit. The body includes a conveyance path through which a sheet passes, an outlet path connecting the downstream end of the conveyance path to a destination device, a reverse slot that is an opening of the body connected to the downstream end of the conveyance path and where a sheet reverses its direction of motion, and a return path connecting the reverse slot to the conveyance path. The conveyance unit conveys a sheet through the conveyance path. The switching unit switches, at the downstream end of the conveyance path, a destination of a sheet between the outlet path and the reverse slot. The delivery unit delivers a sheet from the outlet path to a destination device. The reverse unit first conveys a sheet to a position where a portion of the sheet hangs out of the reverse slot outside the body, and then moves the sheet in the reverse direction from the position to the return path. The return unit conveys a sheet through the return path to return the sheet face down to the conveyance path. The controller unit, when at least one of the conveyance unit, the reverse unit, and the return unit is conveying one or more sheets at the time of detection of a jam in the destination device, controls the conveyance unit, the reverse unit, and the return unit to continue to convey the one or more sheets to purge the one or more sheets from the reverse slot to the outside of the body or to convey the one or more sheets to the outlet path. The controller unit further, when controlling the conveyance unit, the reverse unit, and the return unit to continue to convey the one or more sheets, controls the switching unit to convey a leading sheet to the reverse slot if a first condition is satisfied, or to convey the leading sheet to the outlet path if a second condition is satisfied. The leading sheet is, of the one or more sheets, a sheet that first reaches the downstream end of the conveyance path. The first condition is satisfied when no other sheet is present in the reverse slot at the time of detection of the jam, and the second condition is satisfied when another sheet is present in the reverse slot at the time of detection of the jam.

A sheet conveyance system according to one aspect of the invention includes the above-defined sheet conveyance device and a downstream conveyance device, which conveys a sheet from the outlet path to a destination through a path, and when detecting a jam on the path, notifies the controller unit of the jam. The controller unit, when controlling the conveyance unit, the reverse unit, and the return unit to continue to convey the one or more sheets, issues a stop signal if the second condition is satisfied. In response to the stop signal, the downstream conveyance device stops the leading sheet upstream from a location where the jam is detected.

An image forming device according to one aspect of the invention includes an image forming unit for forming an image on a sheet and the above-defined sheet conveyance device, which conveys the sheet from the image forming unit through the conveyance path to a destination device.

An image forming system according to one aspect of the invention includes an image forming unit, the above-defined sheet conveyance device, and a post-processing device. The image forming unit forms an image on a sheet. The sheet conveyance device conveys the sheet from the image forming unit through the conveyance path. The post-processing device conveys the sheet from the outlet path through a path, and performs post-processing on the sheet. The post-processing device further, when detecting a jam on the path, notifies the controller unit of the jam. The controller unit, when controlling the conveyance unit, the reverse unit, and the return unit to continue to convey the one or more sheets, issues a stop signal if the second condition is satisfied. In response to the stop signal, the post-processing device stops the leading sheet upstream from a location where the jam is detected.

BRIEF DESCRIPTION OF THE DRAWINGS

These and other objects, advantages, and features of the invention will become apparent from the following description thereof taken in conjunction with the accompanying drawings which illustrate a specific embodiment of the invention.

In the drawings.

DETAILED DESCRIPTION

The following is a description of embodiments of the invention with reference to the drawings.

Embodiment 1

Outer Appearance of Image Forming System

Figure 1:
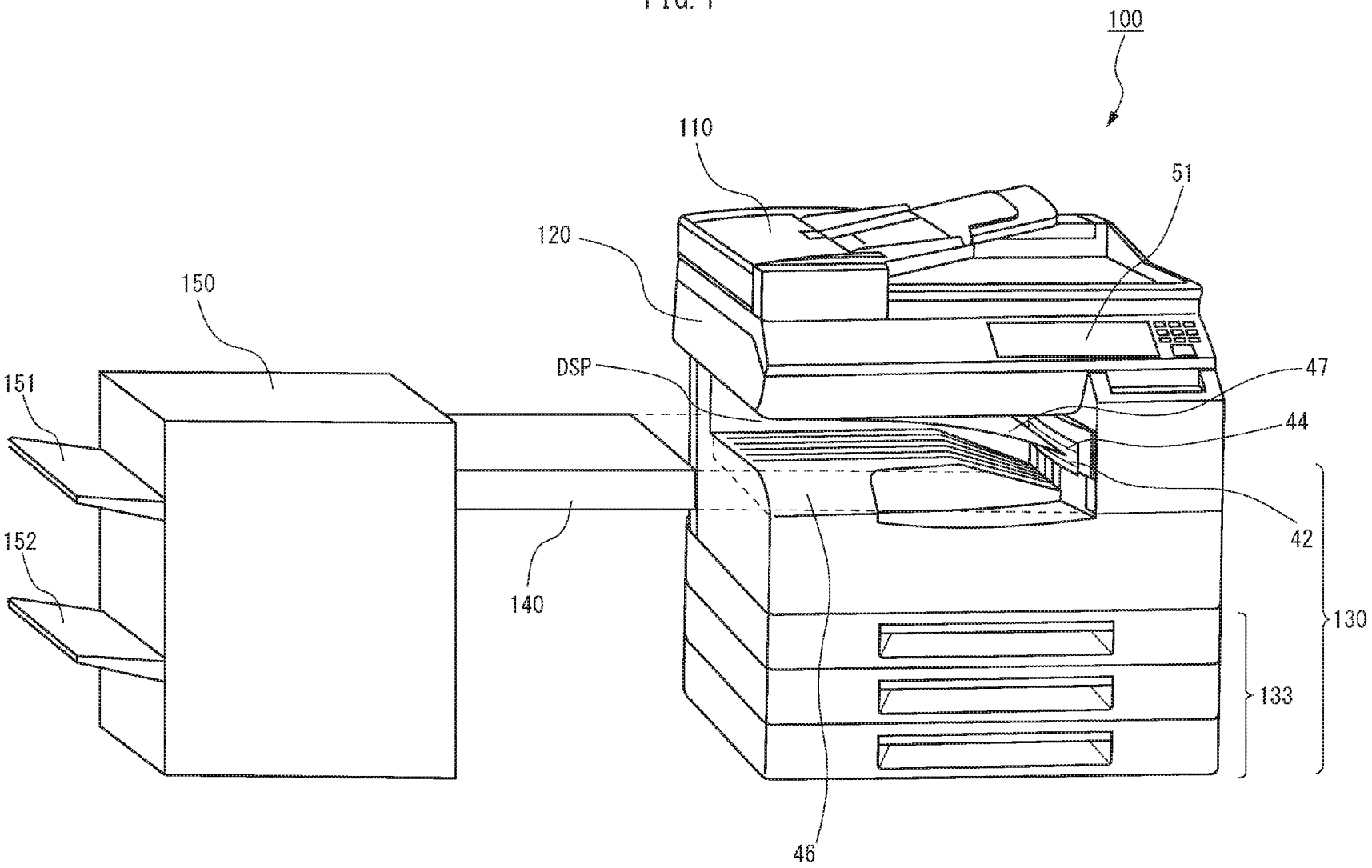
FIG. 1 is a perspective view of the outer appearance of an image forming system according to Embodiment 1 of the invention.

FIG. 1 is a perspective view of the outer appearance of an image forming system according to Embodiment 1 of the invention. The image forming system includes a multi-function peripheral (MFP) 100, a relay unit 140, and a post-processing device 150.

The MFP 100 combines functions of a scanner, color copier, and color laser printer. Referring to FIG. 1, an auto document feeder (ADF) 110 is attachable to an upper surface of a body of the MFP 100. A scanner 120 is housed in an upper portion of the body directly below the ADF 110, and a printer 130 is housed in a lower portion of the body. Paper cassettes 133 are attached to a lower portion of the printer 130, and may be drawn out like drawers.

The MFP 100 is an in-body paper ejection type. In other words, an ejection tray 46 is removably mounted in an area DSP between the scanner 120 and the printer 130 and receives sheets ejected from an ejection slot 42 that opens into the area DSP. A reverse tray 47 is mounted above the ejection tray 46 in the area DSP. During duplex printing, a sheet that is printed on its front side reverses its direction of motion on the reverse tray 47. In other words, the sheet is conveyed to a position where a portion of the sheet hangs out of the reverse slot 44 above the ejection slot 42 on the reverse tray 47, and is then taken back into the reverse slot 44 in the reverse direction.

The relay unit 140 is attached to a portion of the body of the MFP 100 instead of the ejection tray 46. The relay unit 140 receives sheets from the ejection slot 42 and relays the sheets to the post-processing device 150.

The post-processing device 150, in response to instruction from the MFP 100, performs post-processing on sheets received via the relay unit 140 from the ejection slot 42. The post-processing may include, for example, aligning sheets in a stack and stapling the stack. Referring to FIG. 1, the post-processing device 150 includes two ejection trays 151, 152. The upper ejection tray 151 stacks sheets in the same state they are outputted from the ejection slot 42. The lower tray 152 stacks sheets in aligned stacks or stapled stacks, for example.

[Internal Configuration of Image Forming System]

Figure 2:
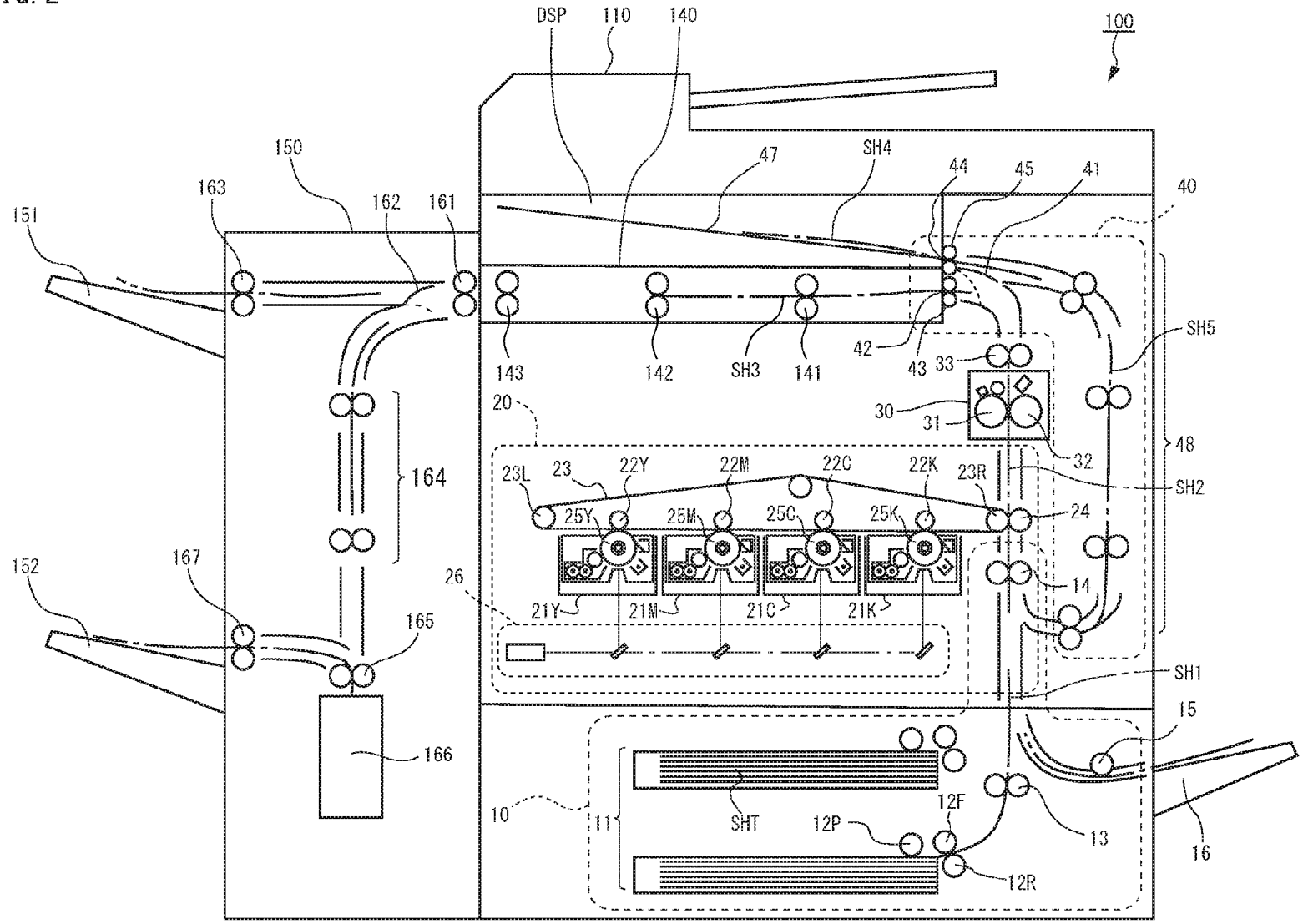
FIG. 2 is a frontal view illustrating a schematic configuration of the inside of the image forming system shown in FIG. 1.

FIG. 2 is a frontal view illustrating a schematic internal configuration of the system 100, 140, 150 shown in FIG. 1. In order to show internal elements, the front face of the body is drawn as if transparent in FIG. 2. Referring to FIG. 2, the printer 130 includes a feeder unit 10, an imaging section 20, a fixing unit 30, and a delivery unit 40. The four elements 10, 20, 30, 40 function as an image forming unit of the MFP 100, which forms toner images on sheets based on image data.

The feeder unit 10 uses a feeder roller group 12P, 12R, 12F, 13, 14, 15 to feed each sheet SH1 from a stack of sheets SHT stored in paper cassettes 11 or on a manual feed tray 16, to the imaging section 20. The sheets SHT that can be stored in the paper cassettes 11 or on the manual feed tray 16 are paper or resin, size A3, A4, A5, B4, etc., and plain, high-quality, coated, etc.

The imaging section 20 forms a toner image on a sheet SH2 conveyed from the feeder unit 10. More specifically, four imaging units 21Y, 21M, 21C, 21K each use laser light from an exposure unit 26 to expose to light surfaces of photoreceptor drums 25Y, 25M, 25C, 25K in patterns based on image data, to form electrostatic latent images on the surfaces. Each imaging unit 21Y, 21M, 21C, 21K then develops a toner image of a corresponding color, yellow (Y), magenta (M), cyan (C), black (K) from the corresponding electrostatic latent image. The four toner images are then transferred in order onto the same overlapping position on a surface of an intermediate transfer belt 23 from the photoreceptor drums 25Y, 25M, 25C, 25K, according to an electric field generated between primary transfer rollers 22Y, 22M, 22C, 22K and the photoreceptor drums 25Y, 25M, 25C, 25K. Thus, a color toner image is formed on the same overlapping position. The color toner image and the sheet SH2 conveyed from the feeder unit 10 simultaneously pass through a nip formed between the intermediate transfer belt 23 and a secondary transfer roller 24, and then receive an electric field therebetween. The color toner image is thereby transferred to the sheet SH2. Subsequently, the secondary transfer roller 24 sends the sheet SH2 to the fixing unit 30.

The fixing unit 30 thermally fixes the color toner image to the sheet SH2 conveyed from the imaging section 20. More specifically, when the sheet SH2 passes through a nip between a fixing roller 31 and a pressure roller 32, the fixing roller 31 applies heat from a heater within the fixing roller 31 to the sheet SH2, and the pressure roller 32 applies pressure to the heated portion of the sheet SH2, pressing the sheet SH2 against the fixing roller 31. The toner image is fixed onto a surface of the sheet SH2 according to the heat from the fixing roller 31 and the pressure from the pressure roller 32. Subsequently, a pre-ejection roller 33 sends the sheet SH2 to the delivery unit 40.

The delivery unit 40 delivers the sheet SH2 from the pre-ejection roller 33 to the relay unit 140 or makes the sheet SH2 reverse direction on the reverse tray 47. Referring to FIG. 2, the delivery unit 40 includes a switching claw 41, the ejection slot 42, an ejection roller 43, the reverse slot 44, a reverse roller 45, and a return path 48. The switching claw 41 is a claw-shaped or plate-shaped member, a base of which is rotatably fixed between the ejection slot 42 and the reverse slot 44, and a tip of which is movable up and down by rotation about the base. The switching claw 41 forms a path (hereinafter, "outlet path") to the ejection slot 42 by raising the tip when it should deliver a sheet from the pre-ejection roller 33 to the relay unit 140, and forms a path (hereinafter, "reverse path") to the reverse slot 44 by lowering the tip when it should make a sheet conveyed from the pre-ejection roller 33 reverse its direction of motion at the reverse slot 44. The ejection slot 42 and the reverse slot 44 are each narrow slits elongated in the horizontal direction that are openings in the body of the MFP 100 to the area DSP. The ejection roller 43 is disposed inside the body by the ejection slot 42. The circumferential surface of the ejection roller 43 rotates to output a sheet SH3 moved along the switching claw 41 from the ejection slot 42 to the relay unit 140. The reverse roller 45 is disposed inside the body by the reverse slot 44 and is rotatable in a forward direction and a reverse direction. The reverse roller 45 first rotates in the forward direction so that the circumferential surface thereof outputs a sheet SH4 that moved along the switching claw 41 out of the reverse slot 44 to rest on the reverse tray 47. The reverse roller 45 then reverses its rotation just prior to the rear end of the sheet SH4 passing through the reverse slot 44, thus taking back the sheet SH4 from the reverse tray 47 into the reverse slot 44, i.e., reversing the direction of motion of the sheet SH4 to convey it to the return path 48. In the return path 48, a plurality of transport rollers return a sheet SH5 conveyed by the reverse roller 45, face down, to the conveyance path of the feeder unit 10. Subsequently, the feeder unit 10 again conveys the sheet SH5 to the imaging section 20, and the imaging section 20 forms a toner image on the reverse side of the sheet SH5. The fixing unit 30 again performs heat processing of the sheet SH5 and the delivery unit 40 this time delivers the sheet SH5 to the relay unit 140.

The relay unit 140 uses conveyance rollers 141, 142, 143 to deliver sheets conveyed from the ejection slot 42 to the post-processing device 150.

The post-processing device 150, in addition to the ejection trays 151, 152, includes a feed roller 161, a sorting claw 162, an upper ejection roller 163, a conveyance roller group 164, a reverse roller 165, a post-processing unit 166, and a lower ejection roller 167. The feed roller 161 receives sheets from the relay unit 140 and takes the sheets into the body of the post-processing device 150. The sorting claw 162 is a claw-shaped or plate-shaped member, a base of which is rotatably fixed, and a tip of which is movable up and down by rotation about the base. The sorting claw 162 forms a path to the upper ejection roller 163 by lowering the tip when it should convey a sheet drawn in by the feed roller 161 to the upper ejection roller 163, and forms a path to the conveyance roller group 164 by raising the tip when it should deliver a sheet drawn in by the feed roller 161 to the post-processing unit 166. The upper ejection roller 163 is disposed in the vicinity of a base end of the upper ejection tray 151 and ejects sheets that move along the sorting claw 162 from the feed roller 161 to the upper ejection tray 151. The conveyance roller group 164 conveys sheets that move along the sorting claw 162 from the feed roller 161 in the direction of the post-processing unit 166 as far as the reverse roller 165. The reverse roller 165 is disposed at the entrance to the post-processing unit 165 and is rotatable in a forward direction and a reverse direction. The reverse roller 165 first rotates in the forward direction so that the circumferential surface thereof conveys the sheets delivered by the conveyance roller group 164 to the post-processing unit 166. The reverse roller 165 then rotates in reverse so that the circumferential surface thereof draws out a stack of sheets from the post-processing unit 166 after post-processing. The post-processing unit 166 accumulates and stacks a predefined number of sheets received from the reverse roller 165, and performs post-processing such as aligning and stapling the stack. The lower ejection roller 167 is disposed in the vicinity of a base portion of the lower ejection tray 152 and ejects to the lower ejection tray 152 a stack of sheets the reverse roller 165 draws out from the post-processing unit 166.

[Sheet Conveyance Unit]

As illustrated in FIG. 2, the feeder unit 10 and the delivery unit 40, as well as portions of the imaging section 20 and the fixing unit 30 such as a drive roller 23R of the intermediate transfer belt 23, the secondary transfer roller 24, the fixing roller 31, the pressure roller 32, and the pre-ejection roller 33 function as a sheet conveyance unit in the MFP 100.

Figure 3:
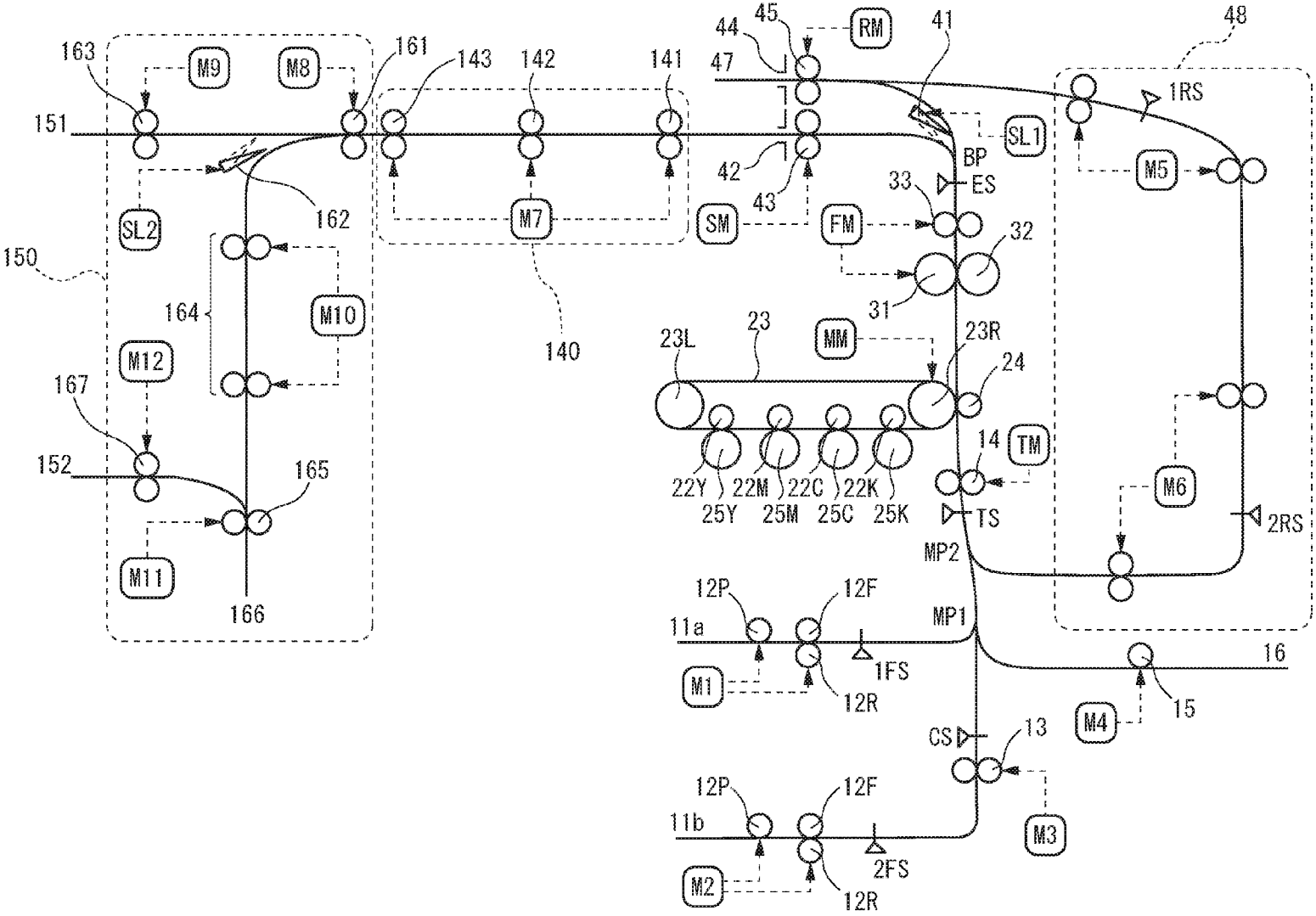
FIG. 3 is a schematic diagram illustrating paths along which a sheet is conveyed by a sheet conveyance device in the image forming system shown in FIG. 2.

FIG. 3 is a schematic diagram illustrating sheet conveyance paths of the sheet conveyance unit. Referring to FIG. 3, the conveyance paths are configured as described below. Initially, three feed paths from paper cassettes 11*a*, 11*b* and the manual feed tray 16 join together into one path (hereinafter, "conveyance path") at a first merge point MP1. The conveyance path extends through the imaging section 20 and the fixing unit 30 until branching into two paths, an outlet path and a reverse path, at a branch point BP where the conveyance path faces the switching claw 41 of the delivery unit 40. The outlet path passes through the ejection slot 42 and connects to the conveyance path in the relay unit 140, while the reverse path connects to the return path 48 at the reverse slot 44. The return path 48 connects to the conveyance path at a second merge point MP2 in the vicinity of a timing roller 14.

Roller groups 12P, 12F, 12R shown in FIG. 2 are also illustrated on the conveyance paths shown in FIG. 3, along with a plurality of light sensors 1FS, 2FS, CS, TS, ES, 1RS, 2RS. Each of the light sensors 1FS, etc. detects sheets passing through its location. More specifically, each light sensor includes a light emitter and a light receiver. The light emitter emits a predefined wavelength of light such as infrared and the light receiver detects the predefined wavelength of light. While one sheet is passing through the location of a light sensor, the sheet interrupts light emitted from the emitter before it reaches the receiver or reflects light towards the receiver. This interruption or reflection of emitted light changes output of the receiver, and the change is detected as a sheet passing through the location of the light sensor. This detection is communicated by the conveyance unit to a primary controller 60, as described later (see FIG. 5). According to this communication, the primary controller 60 determines, as indicated below, whether irregularity occurs in conveyance timing as a result of jams, etc.

Feed sensors 1FS, 2FS are disposed at the start of the conveyance paths indicated in FIG. 3, i.e., in the vicinity of the paper cassettes 11*a*, 11*b*. Depending on whether or not timing of sheets passing the feed sensors 1FS, 2FS is delayed, it can be determined whether each sheet fed by the feed roller group 12P, 12F, 12R enters the conveyance path at a normal timing.

On the path from the paper cassette 11*b*, in addition to a vertical conveyance roller 13, a vertical conveyance sensor CS is located just before the first merge point MP1. Depending on whether or not timing of sheets passing the vertical conveyance sensor CS is delayed, it can be determined whether each sheet fed by the vertical conveyance roller 13 is conveyed to the first merge point MP1 at a normal timing.

The timing roller 14 and a timing sensor TS are disposed in the vicinity of the boundary between the feeder unit 10 and the imaging section 20, downstream of both the first merge point MP1 and the second merge point MP2. The timing roller 14 is typically stopped, and sheets conveyed from the paper cassettes 11*a*, 11*b*, the manual feed tray 16, and the return path 48 are temporarily stopped at the location of the timing roller 14. The timing roller 14 starts rotation according to a timing indicated by a drive signal from the primary controller 60, thereby conveying a stopped sheet to the imaging section at the timing indicated. Depending on whether or not passage of a sheet indicated by output of the timing sensor TS is delayed, it can be determined whether or not the sheet reaches the timing roller 14 at a normal timing and whether or not the sheet is conveyed from the timing roller 14 at a normal timing. Further, it is possible to measure size of a sheet from a time required for the timing roller 14 to convey the sheet.

An ejection sensor ES is located upstream of the branch point BP. Depending on whether or not passage of a sheet indicated by output of the ejection sensor ES is delayed, it can be determined whether or not the sheet is conveyed from the pre-ejection roller 33 at a normal timing and whether or not the ejection roller 43 or the reverse roller 45 receives the sheet at a normal timing.

Return sensors 1RS, 2RS are disposed on the return path 48. Depending on whether or not timing of sheets passing the return sensors 1RS, 2RS is delayed, it can be determined whether each sheet conveyed by a conveyance roller group of the return path 48 is conveyed at a normal timing.

Although not illustrated in FIG. 3, the conveyance paths of the relay unit 140 and the post-processing device 150 are also provided with a plurality of light sensors. By using these light sensors, the post-processing device 150 detects locations of sheets conveyed along the conveyance paths and communicates the locations to the primary controller 60 of the MFP 100 (see FIG. 5). According to this communication, the primary controller 60 determines whether irregularity occurs in conveyance timing and whether or not conveyance failures such as jams occur on the conveyance paths of the relay unit 140 and the post-processing device 150.

Referring to FIG. 3, in the vicinity of the conveyance path are motors M1 to M12, TM, MM, FM, SM, and RM for driving the rollers 12P, etc., and solenoids SL1 and SL2 for driving the switching claw 41 and the sorting claw 162. The motors M1, etc. are, for example, brushless DC (BLDC) motors, and are typically rotatable in both forward and reverse directions. Each of the motors M1, etc. provides torque to a corresponding roller via a transmission system such as a gear, belts, etc. The solenoids SL1 and SL2 use electromagnets to move iron cores (plungers) back and forth in an axial direction to push and pull the switching claw 41 and the sorting claw 162, and thereby move the switching claw 41 and the sorting claw 162 up and down.

In the vicinity of the paper cassettes 11*a*, 11*b*, feed motors M1 and M2 rotate the groups of feed rollers 12P, 12F, 12R. In the vicinity of the path from the paper cassette 11*b*, a vertical conveyance motor M3 rotates the vertical conveyance roller 13. In the vicinity of the path from the manual feed tray 16, a feed motor M4 rotates the feed roller 15.

In the vicinity of the boundary between the feeder unit 10 and the imaging section 20, a timing motor TM rotates the timing roller 14. In the imaging section 20, a main motor MM rotates the drive roller 23R of the intermediate transfer belt 23. In the fixing unit 30, a fixing motor FM drives the fixing roller 31 and the pre-ejection roller 33.

In the delivery unit 40, an ejection motor SM rotates the ejection roller 43 and a reverse motor RM rotates the reverse roller 45 in both forward and reverse directions. The solenoid SL1 moves the switching claw 41 up and down. Along the return path 48, a motor M5 rotates half of the conveyance rollers and a motor M6 rotates the other half of the conveyance rollers.

In the relay unit 140, a conveyance motor M7 rotates the conveyance rollers 141, etc. In the post-processing device 150, a first motor M8 rotates the feed roller 161, the solenoid SL2 moves the sorting claw 162 up and down, a second motor M9 rotates the upper ejection roller 163, and a third motor M10 rotates a conveyance roller group 164. A fourth motor M11 rotates the reverse roller 165 in both forward and reverse directions, and a fifth motor M12 rotates the lower ejection roller 167.

—Sheet Conveyance During Duplex Printing—

The conveyance unit uses the rollers 12P, etc. illustrated in FIG. 3 to convey a sheet from the paper cassettes 11*a*, 11*b*, through the feeder unit 10, the imaging section 20, the fixing unit 30, the delivery unit 40, and the relay unit 140, to the post-processing device 150. More specifically, during duplex printing, a sheet that is printed on a front side thereof is reversed in direction at the reverse slot 44 and returned to the conveyance path face down via the return path 48.

Figure 4A:
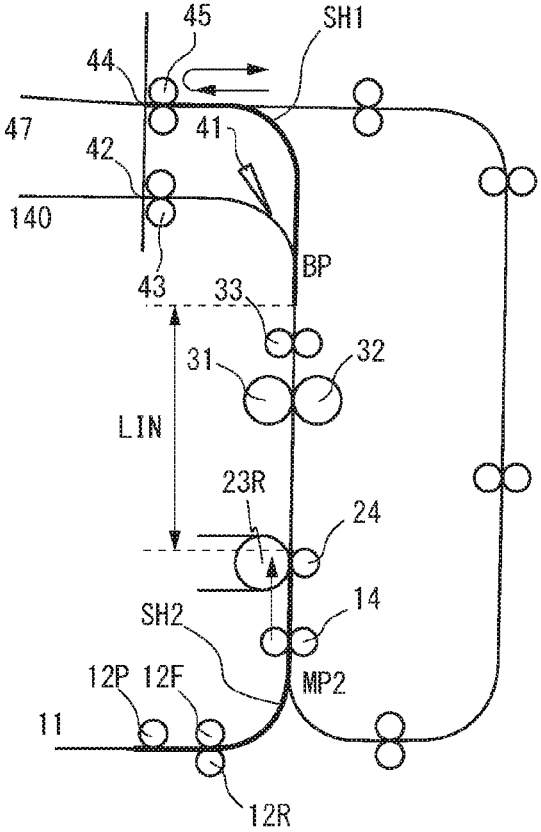
FIGS. 4A, 4B, 4C, and 4D are schematic diagrams illustrating steps of conveying sheets along paths when duplex printing is performed.
Figure 4B:
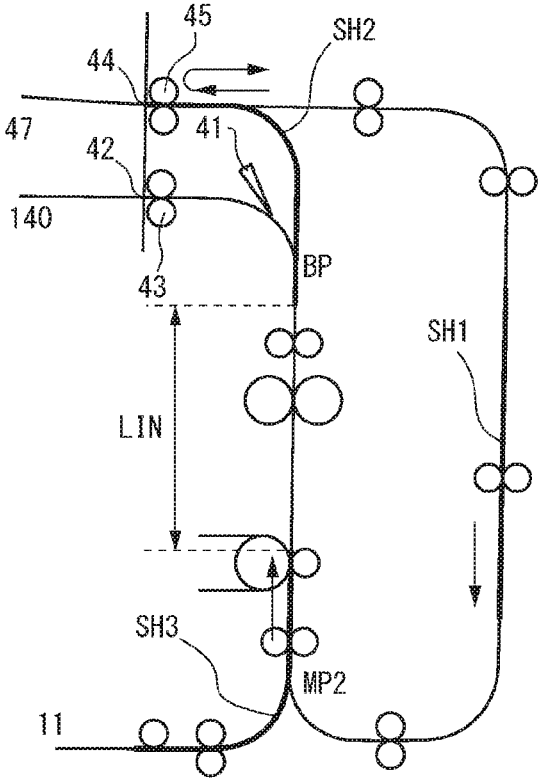
Figure 4C:
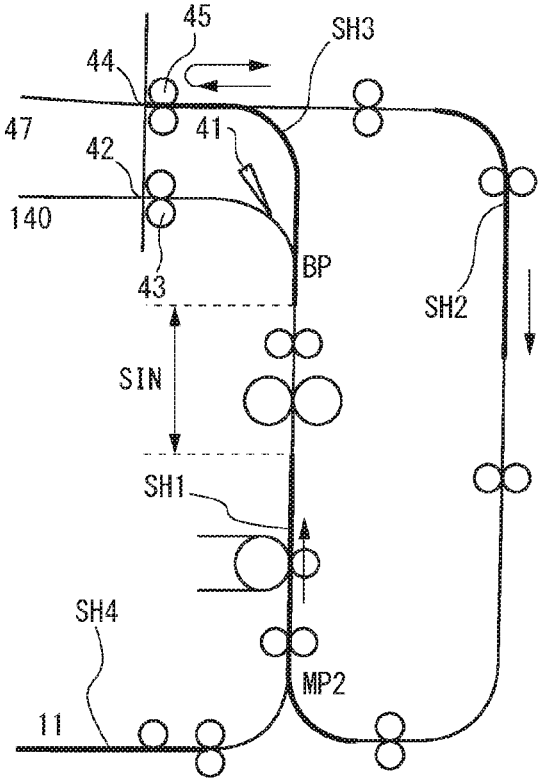
Figure 4D:
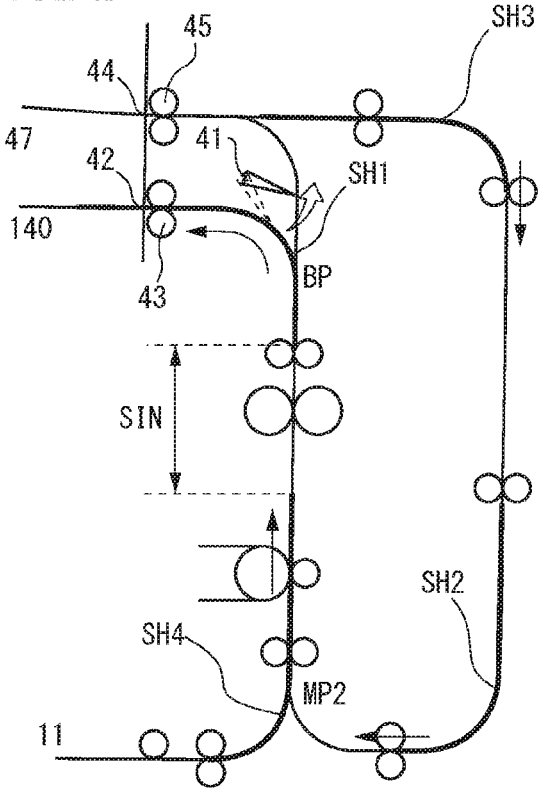

FIGS. 4A, 4B, 4C, and 4D are schematic diagrams illustrating steps of conveying sheets along paths during duplex printing. FIG. 4A shows consecutive printing on the front surfaces of two sheets SH1, SH2. FIG. 4B shows printing on a front surface of a third sheet SH3. FIG. 4C shows printing on a reverse surface of the first sheet SH1. FIG. 4D shows printing on a front surface of a fourth sheet SH4.

Referring to FIG. 4A, two sheets SH1, SH2 are consecutively conveyed from the paper cassette 11 to the conveyance path. At this time, the switching claw 41 already forms the reverse path at the branch point BP with the tip lowered, and therefore the first sheet SH1 follows the reverse path from the branch point BP, moving to the reverse slot 44 and reversing its direction of motion there. The timing roller 14 conveys the second sheet SH2 ensuring a sufficiently long interval LIN between a downstream end (hereinafter, "leading end") of the second sheet SH2 and an upstream end (hereinafter, "trailing end") of the first sheet SH1. The long interval LIN is more specifically set so that, based on a sheet conveyance speed by the conveyance unit, the second sheet SH2 arrives at the reverse slot 44 after the first sheet SH1 is completely conveyed from the reverse slot 44 to the return path 48.

Referring to FIG. 4B, when the second sheet SH2 arrives at the branch point BP, the tip of the switching claw 41 remains lowered to guide the second sheet SH2 to the reverse path. Accordingly, the second sheet SH2 moves from the branch point BP along the reverse path to the reverse slot 44, and there reverses its direction of motion. When the third sheet SH3 is conveyed from the paper cassette 11 to the conveyance path, the timing roller 14 ensures a sufficiently long interval LIN between the leading end of the third sheet SH3 and the trailing end of the second sheet SH2. Thus, the third sheet SH3 arrives at the reverse slot 44 after the second sheet SH2 is completely conveyed from the reverse slot 44 to the return path 48.

Referring to FIG. 4C, when the third sheet SH3 arrives at the branch point BP, the tip of the switching claw 41 remains lowered to guide the third sheet SH3 to the reverse path. Accordingly, the third sheet SH3 moves from the branch point BP along the reverse path to the reverse slot 44, and reverses its direction of motion. When the first sheet SH1 returns from the return path 48 to the second merge point MP2, the timing roller 14 delivers the first sheet SH1 early, ensuring a sufficiently short interval SIN between the leading end of the first sheet SH1 and the trailing end of the third sheet SH3. Thus, the fourth sheet SH4 can be moved along the conveyance path before the second sheet SH2.

Referring to FIG. 4D, before the first sheet SH1 arrives at the branch point BP, the switching claw 41 raises its tip to switch destinations to the outlet path. Accordingly, the first sheet SH1 follows the outlet path from the branch point BP to be delivered to the relay unit 140 from the ejection slot 42. The fourth sheet SH4 is fed to the conveyance path from the paper cassette 11 before the second sheet SH2 returns to the second merge point MP2 from the return path 48. At this time, the timing roller 14 conveys the fourth sheet SH4 into the path ensuring a sufficiently short interval SIN between the leading end of the fourth sheet SH4 and the trailing end of the first sheet SH1, allowing the second sheet SH2 to be conveyed to the conveyance path.

The conveyance unit thus alternates conveyance of sheets to be printed on their front side and sheets to be printed on their reverse side at appropriate timings. The conveyance unit thus maintains reliability and productivity of the MFP 100 by preventing contact of sheets at the reverse slot 44.

[Electronic Control System of Image Forming System]

Figure 5:
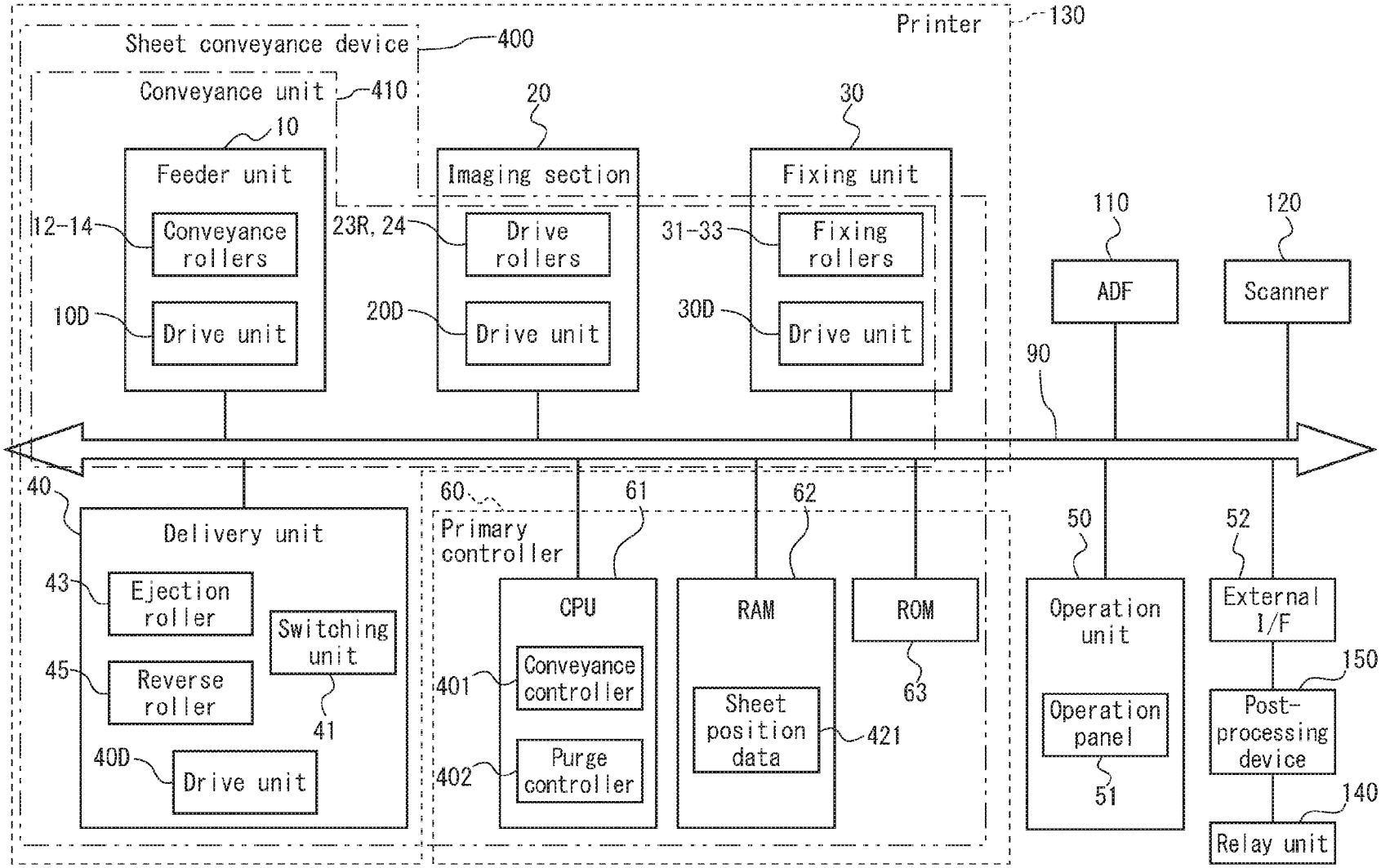
FIG. 5 is a block diagram illustrating an electronic control system of the image forming system shown in FIG. 1.

FIG. 5 is a block diagram illustrating a configuration of the electronic control system of the MFP 100. Referring to FIG. 5, in the electronic control system, in addition to the ADF 110, the scanner 120, and the printer 130, an operation unit 50, an external interface (I/F) 52, and the primary controller 60 are connected to a bus 90 to be able to communicate with each other.

—Operation Unit—

The operation unit 50 accepts job requests and image data to be printed, via user operations and/or communication with an external electronic device, and communicates received job requests and image data to the primary controller 60. Referring to FIG. 5, the operation unit 50 includes an operation panel 51. The operation panel 51 is disposed on a front surface of the body of the MFP 100, as shown in FIG. 1, and includes a push button, a touch panel, and a display. The operation unit 50 controls the operation panel 51 to display a graphical user interface (GUI), such as an operation screen and a parameter input screen. The operation unit 50 identifies the push button or a location of the touch panel operated by a user, and communicates information related to the identification to the primary controller 60 as operation data.

—External I/F—

The external I/F 52 includes a Universal Serial Bus (USB) port or memory card slot, and directly accepts image data to be printed from an external memory device such as a USB memory or a hard disk drive (HDD). The external I/F 52 further accepts image data to be printed from other electronic devices on an external network by wired or wireless connection to the external network (not illustrated in FIG. 5). The external I/F 52 further relays data between the electronic control system and the primary controller 60 by connection to the electronic control system of the post-processing device 150.

—Primary Controller—

The primary controller 60 is an electronic circuit implemented on one substrate, and the substrate is mounted inside the MFP 100. Referring to FIG. 5, the primary controller 60 includes a CPU 61, a RAM 62, and a ROM 63. The CPU 61 controls the elements 10, 20, etc. connected to the bus 90 according to firmware. The RAM 62 provides the CPU 61 with a workspace to execute firmware and stores image data to be printed that is received by the operation unit 50. The ROM 63 includes a non-writable semiconductor memory device and a writable semiconductor memory device such as EEPROM or a HDD. The former stores firmware and the latter provides the CPU 61 with storage for data such as environmental variables.

The CPU 61 executes firmware, and the primary controller 60 thereby controls elements of the MFP 100 based on operation data from the operation unit 50. More specifically, the primary controller 60 makes the operation unit 50 display an operation screen and accept operations from a user. In response to each operation, the primary controller 60 determines an operation mode such as a running mode, a waiting mode, or a sleep mode, notifies other elements of the operation mode, and makes the other elements execute processing according to the operation mode.

For example, when the operation unit 50 receives a job from a user, the primary controller 60 makes the operation unit 50 transfer image data to be printed to the RAM 62. The primary controller 60 further, according to printing conditions indicated in the job, specifies to the feeder unit 10 the type of sheet to be fed and timing of sheet feeding, provides image data representing the toner image to be formed to the imaging section 20, specifies to the fixing unit 30 a surface temperature of the fixing roller 31 to be maintained, and specifies to the delivery unit 40 a conveyance destination and switching timing at the branch point BP.

The primary controller 60 monitors operational statuses of each element 10, 20, etc. of the MFP 100 and conveyance statuses of sheets, and if an error is detected, promotes resolution of the error by making an appropriate change to the operation mode. For example, upon detecting an unusual delay in timing of conveyance of a sheet past one of the light sensors IFS, etc. shown in FIG. 3, the primary controller 60 makes the printer 130 stop processing and makes the operation panel 51 display a message indicating that a jam has occurred to prompt a user to resolve the error. Upon detecting a paper shortage in one of the paper cassettes 11*a*, 11*b*, or a toner shortage in one of the imaging units 21Y, 21M, 21C, 21K, the primary controller 60 makes the printer 130 stop processing and makes the operation panel 51 display a message indicating the paper/toner shortage to prompt a user to replenish the paper/toner.

Referring again to FIG. 5, the primary controller 60 includes a conveyance controller 401 and a purge controller 402. These functional units 401, 402 are implemented by the CPU 61 executing specialized firmware. In other words, the functional units 401, 402, together with the conveyance unit 410, contribute to forming the sheet conveyance device 400 of the MFP 100. The conveyance controller 401 controls operation of the sheet conveyance device 400 during normal job processing. The purge controller 402 makes the sheet conveyance device 400 execute purging when the printer 130 stops processing due to an error such as a jam. The functional units 401, 402 are described in detail later.

—Printer—

Referring to FIG. 5, each element 10, 20, 30, 40 of the printer 130 includes a drive unit 10D, 20D, 30D, 40D. The drive units 10D, etc. control the conveyance rollers 12P, etc., and the motors M1, etc. and solenoids SL1, etc. for driving various moving members included in the conveyance unit 410. The drive units 10D, 20D, etc. use various sensors to monitor operational statuses of the elements 10, 20, etc. of the MFP 100 and conveyance statuses of sheets, and notify the primary controller 60 upon detection of an error by a sensor. The various sensors, in addition to the light sensors shown in FIG. 3 1FS, etc., include location sensors for detecting position and/or orientation of movable members such as the photoreceptor drums 25Y, etc. and the fixing roller 31, sensors for detecting a paper shortage in the paper cassettes 11*a*, 11*b*, and sensors for detecting toner shortage in the imaging units 21Y, 21M, 21C, 21K.

[Conveyance Controller]

The conveyance controller 401 controls the drive units 10D, 20D, etc. according to the operation mode of the MFP 100 and conditions of a job, and makes the conveyance unit 410 convey an appropriate type of sheet at an appropriate timing.

The conveyance controller 401 initially indicates which paper cassette, etc., the drive unit 10D of the feeder unit 10 should select as a paper source, and indicates the timing at which the feed rollers 12P, 12F, 12R, 15 pick up sheets from the selected paper source. According to these indications, the conveyance controller 401 makes the drive units 10D, 20D, 30D, 40D monitor the conveyance status of each sheet fed from the feeder unit 10, and in particular tracks the positions of each sheet on the conveyance path. More specifically, the conveyance controller 401 uses a timer to measure time elapsed since the feed rollers 12P, 12F, 12R, 15 pick up each sheet. Because a sheet conveyance speed is defined by a standard value, i.e., a system speed, for each operation mode, the conveyance controller 401, based on the standard value of the conveyance speed and the time elapsed since the sheet was picked up, calculates a travel distance of the sheet periodically, e.g. every 10 ms to 100 ms, and from calculated values, determines the current position of the sheet. The conveyance controller 401 stores data relating to the position of each sheet in the RAM 62 as an entry in sheet position data 421. The sheet position data 421 defines entries for sheets in conveyance order. Based on the sheet position data 421, the conveyance controller 401 predicts the next light sensor 1FS, etc. each sheet will pass, and when the light sensor should detect the sheet. Based on the difference between the predicted time and the actual time indicated by output from the predicted light sensor, the conveyance controller 401 corrects the current position of each sheet, and by using the corrected value, updates the sheet position data 421.

The conveyance controller 401 then uses the sheet position data 421 to indicate: to the drive unit 10D of the feeder unit 10, a timing at which the timing roller 14 should convey a sheet to the imaging section 20; to the drive unit 40D of the delivery unit 40, orientation of the tip of the switching claw 41 and a timing at which the orientation should be switched, and a timing at which the reverse roller 45 should switch from forward rotation to reverse rotation.

The conveyance controller 401 further detects unusual delays in sheet conveyance timing that result from conveyance failure such as jams, based on the sheet position data 421, notifications from the drive units 10D, etc., and output from the light sensors 1FS, etc. Events considered to be unusual delays include, for example, (i) excess over an acceptable range of the difference between the predicted time at which a sheet is to pass the location of a light sensor 1FS, etc. and the actual time at which output from the light sensor indicates that the sheet passes the location; and (ii) excess over an acceptable range of the time elapsed from the predicted time while the light sensor continues to indicate that the sheet has not passed.

[Purge Controller]

When interrupting the printer 130, the primary controller 60 activates and makes the purge controller 402 execute a purge. A "purge" is an operation to automatically eject from the conveyance path, among sheets being conveyed on the conveyance path, sheets that can be further conveyed. A purge destination of each sheet is set to a destination to which the sheet can be ejected, without limiting its original destination such as an ejection tray. Events that cause the primary controller 60 to interrupt the printer 130 include the following cases: (1) the primary controller 60 received a job cancellation from a user or external device; (2) the conveyance controller 401 detects conveyance failure such as a jam or double feeding at any of the elements 10, 40, etc. of the conveyance unit 410; (3) the post-processing device 150 notified the primary controller 60 of conveyance failure such as a jam; and (4) an element of the MFP 100 notified the primary controller 60 of irregularity of the element itself or sheet such as paper shortage, toner shortage, etc. In such a case, the purge controller 402 initially specifies conveyable sheets as purge targets from the sheet conveyance data 421, next determines purge destinations and conveyance order for the targets, then makes the conveyance unit 410 continue conveying the targets to eject them to their respective purge destinations in the conveyance order. Thus, conveyable sheets on the conveyance path are removed, and accordingly the printer 130 can rapidly resume processing after the event that caused the interruption is resolved, for example, after a user removes a sheet that caused a jam.

When the relay unit 140 or post-processing device 150 detects a jam therein, the conveyance path shown in FIG. 3 has the reverse tray 47 of the MFP 100 as the only location to which a sheet is to be ejected. Accordingly, the purge controller 402 sets the reverse tray 47 to be the purge destination. The purge controller 402 makes the switching claw 41 switch the conveyance destination of a sheet that reaches the branch point BP first among purge targets, either to the reverse slot 44 when a first condition is satisfied, or to the outlet path when a second condition is satisfied. The first condition is set to be satisfied when no other sheet is present in the reverse slot 44 at the time of detection of the jam. The second condition is set to be satisfied when another sheet is present in the reverse slot 44 at the time of detection of the jam.

When the second condition is satisfied, the purge controller 402 transmits a stop signal to the post-processing device 150. In response to the stop signal, the post-processing device 150 stops rotation of a conveyance roller located upstream of a position at which the jam was detected on the conveyance path shown in FIG. 3. Thus, the leading end of a sheet conveyed from the ejection slot 42 is stopped at the position of the stopped conveyance roller. The purge controller 402 selects the conveyance roller that the post-processing device 150 should stop so that the trailing end of the sheet is conveyed to a position nearer the ejection slot 42 than the branch point BP and thus will not contact a sheet subsequently passing through the branch point BP.

—First Condition is Satisfied—

Figure 6A:
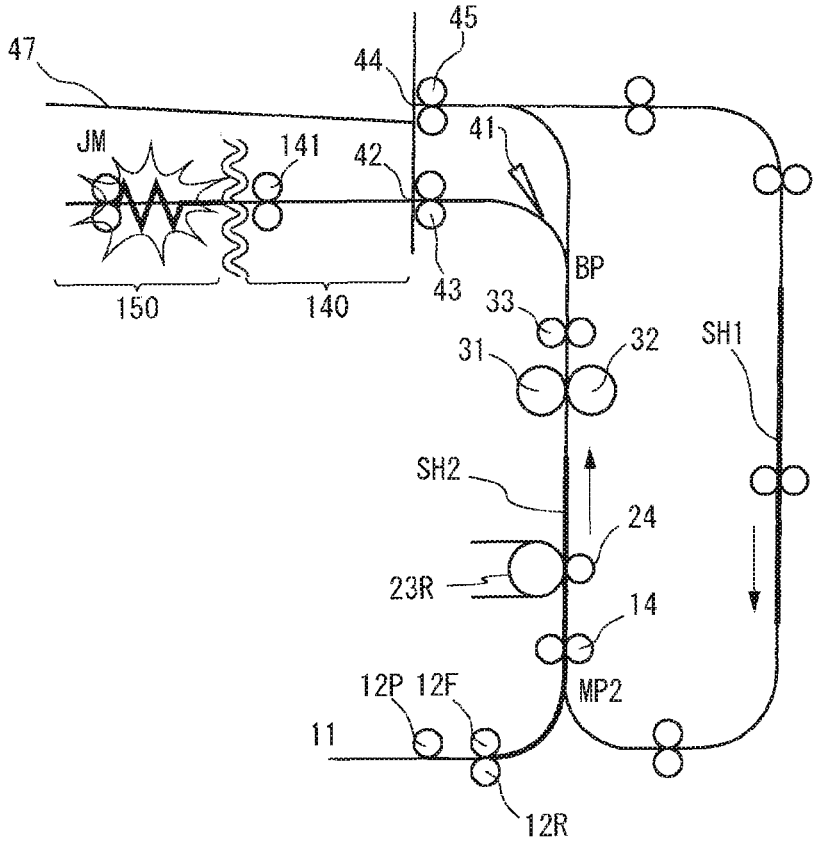
FIGS. 6A and 6B are schematic diagrams illustrating positions of sheets that are purged in a case in which no sheets are present in a reverse slot at the time of detection of a jam in a post-processing device that is a conveyance destination.

FIG. 6A is a schematic diagram illustrating positions of sheets SH1, SH2 that are being conveyed at the time of detection of a jam JM in the post-processing device 150. When receiving a notification of detection of the jam JM from the post-processing device 150, the primary controller 60 interrupts the printer 130 and activates the purge controller 402. The purge controller 402 reads the sheet position data 421 from the RAM 62 and specifies the positions of the sheets SH1, SH2 that are being conveyed on the conveyance path. As shown in FIG. 6A, the sheets SH1, SH2 are both targets for duplex printing; at the time of detection of the jam JM, the first sheet SH1 is being conveyed on the return path 48 after it is printed on its front surface and reverses its direction of motion at the reverse slot 44, while the second sheet SH2 is at a position just prior to printing on its front surface. At the time of detection, the conveyance destination of the second sheet SH2 at the branch point BP is the reverse slot 44, and therefore the switching claw 41 lowers its tip and forms the reverse path. The purge controller 402 specifies the positions of the sheets SH1, SH2 from the sheet position data 421, and checks the following conditions: First, the sheets SH1, SH2 can be conveyed to the reverse tray 47 without being impeded by the jam JM. Second, at the time of detection of the jam JM, no sheet is present in the reverse slot 44 and therefore the first condition is satisfied.

Figure 6B:
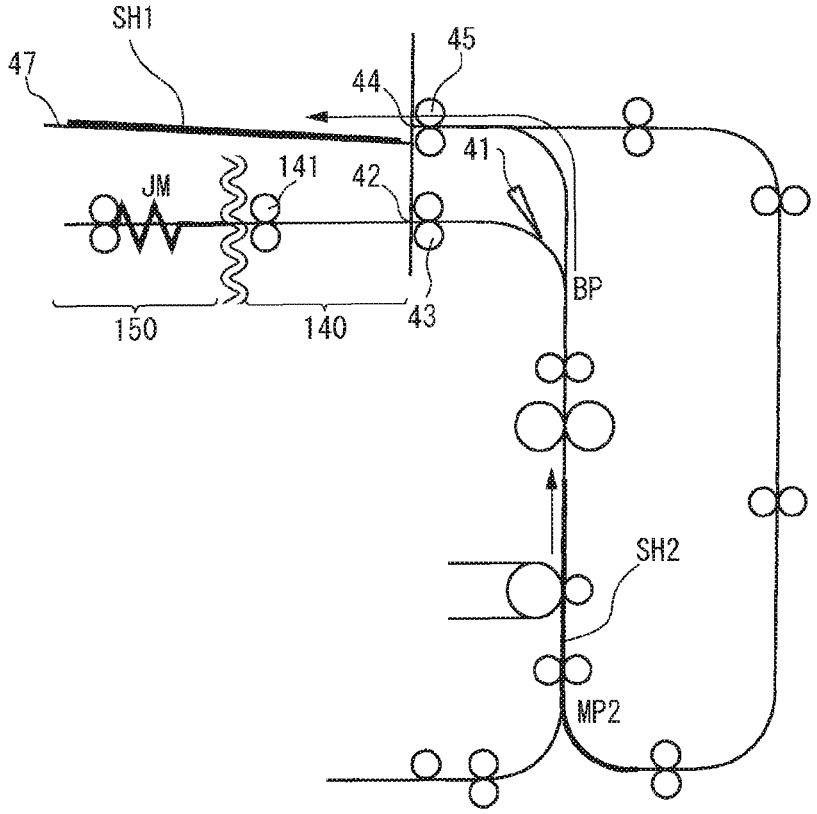

FIG. 6B is a schematic diagram illustrating positions of the sheets SH1, SH2 during purge. The purge controller 402 makes the conveyance unit 410 keep the tip of the switching claw 41 lowered, because the first condition is satisfied at the time of detection of the jam JM. Thus, the conveyance destination from the branch point BP is maintained as the reverse slot 44. The second sheet SH2 arrives at the branch point BP first, proceeds to the reverse slot 44, reverses its direction of motion, and is conveyed to the return path 48. The first sheet SH1 passes from the return path 48 through the second merge point MP2 and arrives at the branch point BP. From the branch point BP the first sheet SH1 proceeds to the reverse tray 47 and is purged. The second sheet SH2 similarly returns from the return path 48, passes through the second merge point MP2 and the branch point BP, and is purged from the reverse slot 44 to the reverse tray 47.

—Second Condition is Satisfied—

Figure 7A:
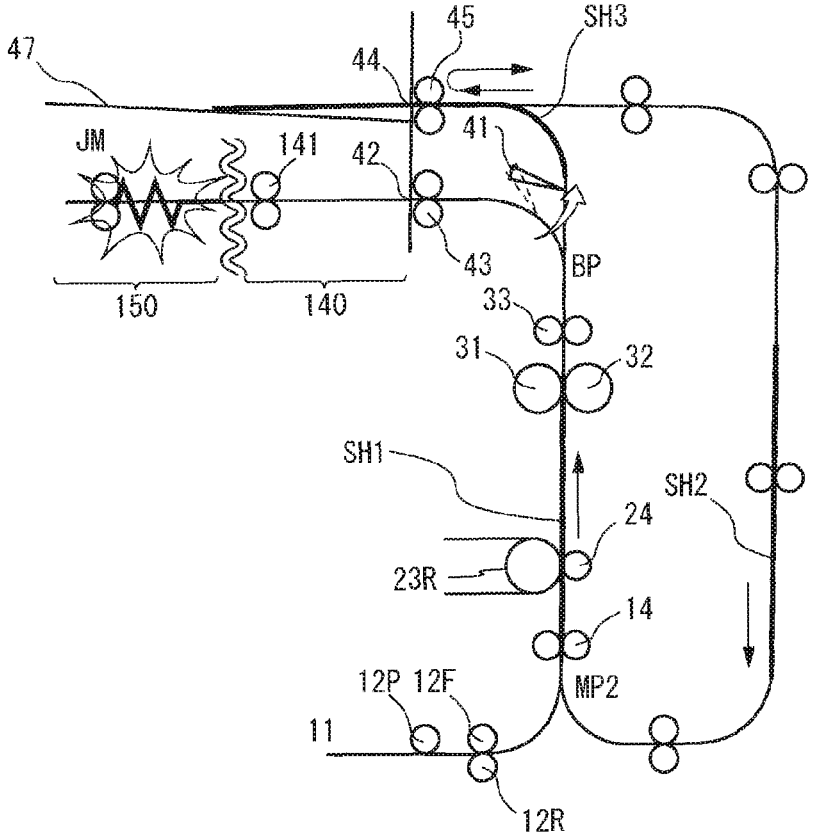
FIGS. 7A and 7B are schematic diagrams illustrating positions of sheets that are purged in a case in which a sheet is present in a reverse slot at the time of detection of a jam in a post-processing device that is a conveyance destination.

FIG. 7A is a schematic diagram illustrating positions of sheets SH1, SH2, SH3 that are being conveyed at the time of detection of a jam JM in the post-processing device 150. When receiving a notification of detection of the jam JM from the post-processing device 150, the primary controller 60 interrupts the printer 130 and activates the purge controller 402. The purge controller 402 reads the sheet position data 421 from the RAM 62 and specifies the positions of the sheets SH1, SH2, SH3 that are being conveyed on the conveyance path. As shown in FIG. 7A, the sheets SH1, SH2, SH3 are targets for duplex printing; at the time of detection of the jam JM, the first sheet SH1 is being printed on its reverse side after reversing its direction of motion at the reverse slot 44 and returning, the second sheet SH2 is being conveyed on the return path 48 after it is printed on its front surface and reversing its direction of motion at the reverse slot 44, and the third sheet SH3 is in the process of reversing its direction of motion at the reverse slot 44 after it is printed on its front surface. At the time of detection, the conveyance destination of the first sheet SH1 at the branch point BP is the ejection slot 42, and therefore the switching claw 41 raises its tip and forms the outlet path. The purge controller 402 specifies the positions of the sheets SH1, SH2, SH3 from the sheet position data 421, and checks the following conditions: First, the sheets SH1, etc. can be conveyed to the reverse tray 47 without being impeded by the jam JM. Second, at the time of detection of the jam JM, the third sheet SH3 is present in the reverse slot 44 and therefore the second condition is satisfied.

Figure 7B:
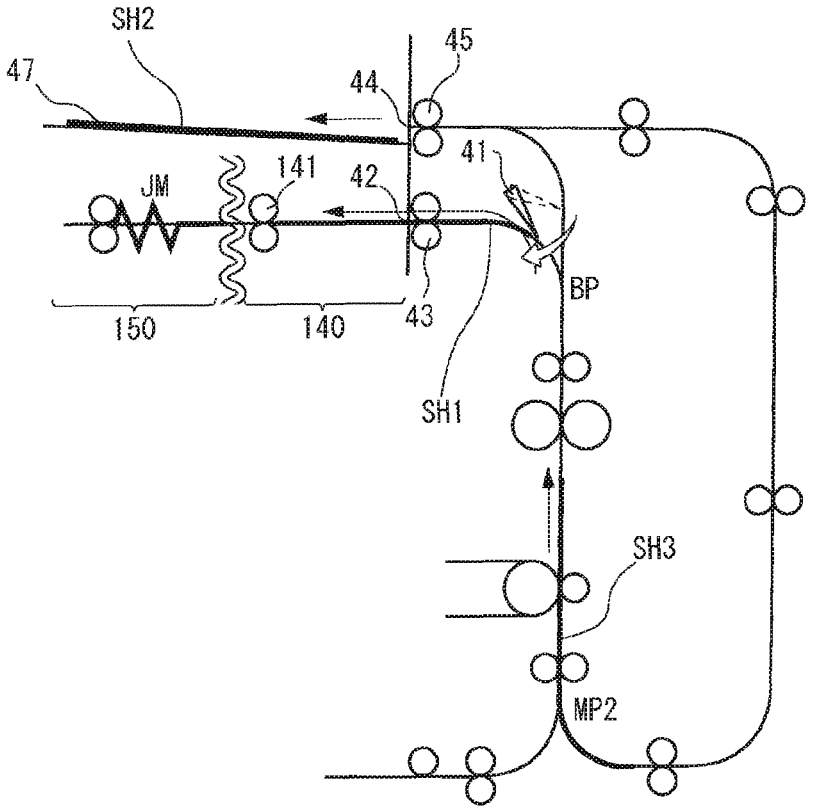

FIG. 7B is a schematic diagram illustrating positions of the sheets SH1, SH2, SH3 during purge. The purge controller 402 makes the conveyance unit 410 keep the tip of the switching claw 41 raised, because the second condition is satisfied at the time of detection of the jam JM. Thus, the first sheet SH1 arrives at the branch point BP first, proceeds to the outlet path, its original destination, and is delivered by the ejection roller 43 from the ejection slot 42 to the relay unit 140. The purge controller 402 transmits a stop signal to the post-processing device 150 so that it stops rotating of the conveyance roller 141 of the relay unit 140. Thus, the first sheet SH1, which is delivered out from the ejection slot 42, stops with its leading end in contact with the conveyance roller 141. At a timing of the trailing end of the first sheet SH1 completely passing through the branch point BP, the purge controller 402 makes the conveyance unit 410 lower the tip of the switching claw 41 to form the reverse path. Subsequently, the second sheet SH2 passes from the return path 48 through the second merge point MP2 and arrives at the branch point BP. From the branch point BP the second sheet SH2 proceeds to the reverse tray 47 and is purged. The third sheet SH3 similarly returns from the return path 48, passes through the second merge point MP2 and the branch point BP, and is purged from the reverse slot 44 to the reverse tray 47.

[Sequence of Purge]

Figure 8:
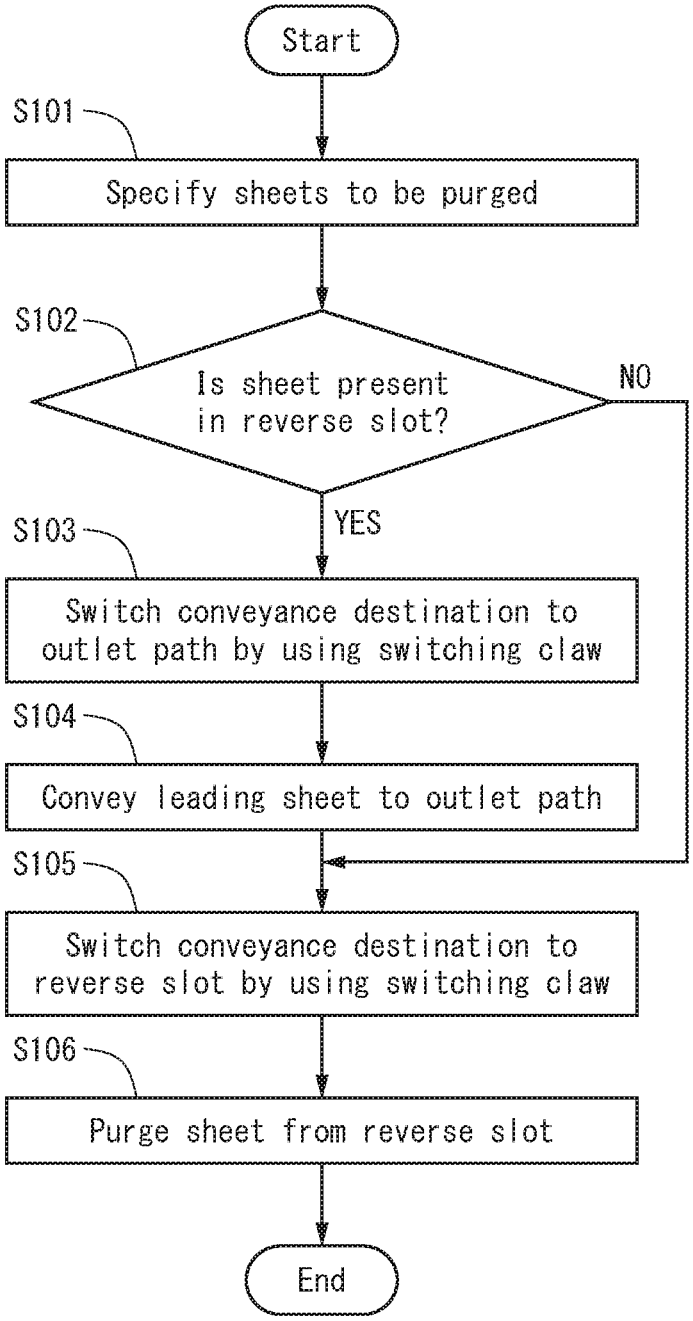
FIG. 8 is a flowchart of the purge illustrated in FIGS. 6A, 6B, 7A, and 7B.

FIG. 8 is a flowchart of the purge illustrated in FIGS. 6A, 6B, 7A, and 7B. This processing starts when the primary controller 60 receives a notification of detection of a jam JM from the post-processing device 150 and determines to interrupt the printer 130.

In step S101, the primary controller 60 activates the purge controller 402. The purge controller 402 first reads the sheet position data 421 from the RAM 62 and specifies the positions of sheets that are being conveyed on the conveyance path. The purge controller 402 then determines whether or not each sheet can be conveyed from its current position to the reverse tray 47 without being impeded by the jam JM, and specifies each conveyable sheet as a purge target. Subsequently, processing proceeds to step S102.

In step S102, the purge controller 402 checks whether or not a sheet is present in the reverse slot 44 at the time of detection of the jam JM. If the sheet is present, processing proceeds to step S103, and if otherwise, to step S105.

In step S103, at the time of detection of the jam JM a sheet is present in the reverse slot 44 and therefore the second condition is satisfied. Accordingly, the purge controller 402 makes the conveyance unit 410 raise the tip of the switching claw 41 to switch to the outlet path the conveyance destination of the leading sheet to first arrive at the branch point BP. The purge controller 402 also transmits a stop signal to the post-processing device 150 so that it stops rotating of the conveyance roller 141 of the relay unit 140. Subsequently, processing proceeds to step S104.

In step S104, the purge controller 402 makes the conveyance unit 410 continue conveying the sheets specified as purge targets in step S101. Because the switching claw 41 is forming the outlet path, the leading sheet follows the outlet path, moves to the relay unit 140 out of the ejection slot 42, and stops with its leading end touching the conveyance roller 141. Thus, the purge controller 402 makes the leading sheet be conveyed to the outlet path. Subsequently, processing proceeds to step S105.

In step S105, no sheet is present in the reverse slot 44 at the time of detection of the jam JM and therefore the first condition is satisfied. Alternatively, when the second condition is satisfied, the leading sheet has already been completely conveyed to the outlet path. Accordingly, the purge controller 402 makes the conveyance unit 410 lower the tip of the switching claw 41 to switch to the reverse slot 44 the conveyance destination of all sheets subsequently arriving at the branch point BP. Subsequently, processing proceeds to step S106.

In step S106, the purge controller 402 makes the conveyance unit 410 continue conveying the sheets specified as purge targets in step S101. When the first condition is satisfied, all purge targets including the leading sheet are purged to the reverse tray 47 after the detection of the jam JM. When the second condition is satisfied, the leading sheet is conveyed to the outlet path and the second and subsequent sheets are purged to the reverse tray 47. Subsequently, processing ends.

Advantages of Embodiment 1

When the destination device, i.e., the relay unit 140 or the post-processing device 150 detects a jam, the sheet conveyance device 400 according to Embodiment 1 of the invention first selects, as sheets to be purged, sheets that the device 400 can convey to the reverse tray 47 of the MFP 100 among the sheets that the device 400 is conveying at the time of detection of the jam, as described above. The sheet conveyance device 400 subsequently, if the first condition is satisfied, purges from the reverse slot 44 to the reverse tray 47 the leading sheet that first reaches the branch point BP after the detection of the jam, and if the second condition is satisfied, conveys the sheet to the outlet path. The first condition is defined as being satisfied when no other sheet is present in the reverse slot 44 at the time of detection of the jam. The second condition is defined as being satisfied when another sheet is present in the reverse slot 44 at the time of detection of the jam. The sheet conveyance device 400 thus prevents the leading sheet from entering the reverse slot 44 when another sheet is present in the reverse slot 44 at the detection of the jam. In this manner, the sheet conveyance device 400 enables the reverse slot 44 to double as a place where sheets are purged while keeping narrow spacing between the sheets conveyed during duplex printing and preventing the sheets being purged from coming into contact with another sheet that is reversing its direction of motion at the reverse slot 44. As a result, the sheet conveyance device 400 can achieve purging without hindering productivity of the image forming system and while reducing the size of its body.

[Modifications]

(A) The image forming device 100 shown in FIG. 1 is an MFP. The image forming device according to Embodiment 1 of the invention may alternatively be a laser printer, an inkjet printer, a fax machine, a copier, etc.

(B) Types of post-processing by the post-processing device 150 may include, in addition to alignment of sheet stacks and stapling of sheet stacks, sheet sorting, punching binding holes in sheets, folding sheets, insertion of a sheet into a sheet stack, etc.

(C) The purge controller 402 makes the conveyance unit 410 eject sheets that are purge targets to the reverse tray 47 in the conveyance order indicated in the sheet position data 421. For example, as shown in FIGS. 6A and 6B, after the time of detection of the jam JM, the second sheet SH2 that first arrives at the branch point BP follows the first sheet SH1 according to the original conveyance order, and therefore the first sheet SH1 is purged to the reverse tray 47 before the second sheet SH2. The purge controller 402 may alternatively make the conveyance unit 410 purge sheets that are purge targets to the reverse tray 47 in the order they arrive at the branch point BP after the time of detection of a jam. For example, in FIGS. 6A and 6B, the second sheet SH2 may be purged to the reverse tray 47 when it first arrives at the branch point BP after the time of detection of the jam.

(D) The purge controller 402, as shown in FIGS. 6A and 6B, determines that the first condition is satisfied because the third sheet SH3 is not present in the reverse slot 44 when the post-processing device 150 detects the jam JM. Regardless of other conditions, the purge controller 402 makes the second sheet SH2, which arrives first at the branch point BP, be conveyed to the reverse slot 44. Alternatively, even if the first condition is satisfied, the purge controller 402 may control the switching claw 44 to cancel conveying of the leading sheet to the reverse slot 44 unless a condition is satisfied that the switching claw 44 can switch the conveyance destination of the next sheet at the time of detection of the jam JM.

In FIGS. 6A and 6B, after the time of detection of the jam JM, the second sheet SH2 that is first to arrive at the branch point BP has just completed being printed thereon, similar to the first sheet SH1 that has already passed the branch point BP. Accordingly, the switching claw 41 is already forming the reverse path, and therefore regardless of when the jam JM is detected in a period from the first sheet SH1 passing the branch point BP to the second sheet SH2 arriving at the branch point BP, the purge controller 402 does not need to make the conveyance unit 410 move the tip of the switching claw 41. Therefore, as long as no sheet is present in the reverse slot 44 at the time of detection of the jam JM, the purge controller 402 can make the conveyance unit 410 convey the second sheet SH2 to the reverse slot 44.

When the leading sheet to first arrive at the branch point BP after the time of detection of the jam JM is a sheet that has been printed on its reverse side and is heading towards the ejection slot 42 unlike a previous sheet that passed the branch point BP before the leading sheet, the switching claw 41 needs to switch the conveyance destination at the branch point BP from the outlet path to the reverse slot 44 in order to purge the leading sheet to the reverse tray 47. If the speed of sheet conveyance can be disregarded relative to the speed of movement of the switching claw 41, then regardless of when the jam JM is detected, the switching claw 41 can form the reverse path before the leading sheet arrives at the branch point BP. Therefore, as long as no sheet is present in the reverse slot 44 at the time of detection of the jam JM, the purge controller 402 can make the conveyance unit 410 convey the leading sheet to the reverse slot 44.

If the speed of sheet conveyance is too high to disregard relative to the speed of movement of the switching claw 41, then the switching claw 41 cannot form the reverse path before the leading sheet arrives at the branch point BP, depending on the timing of detection of the jam JM. In this case, the switching claw 41 may be controlled to cancel switching of the conveyance destination, as described below, even if the first condition is satisfied, unless a condition is satisfied that the switching claw 41 can switch the conveyance destination of the leading sheet at the time of detection of the jam.

Figure 9A:
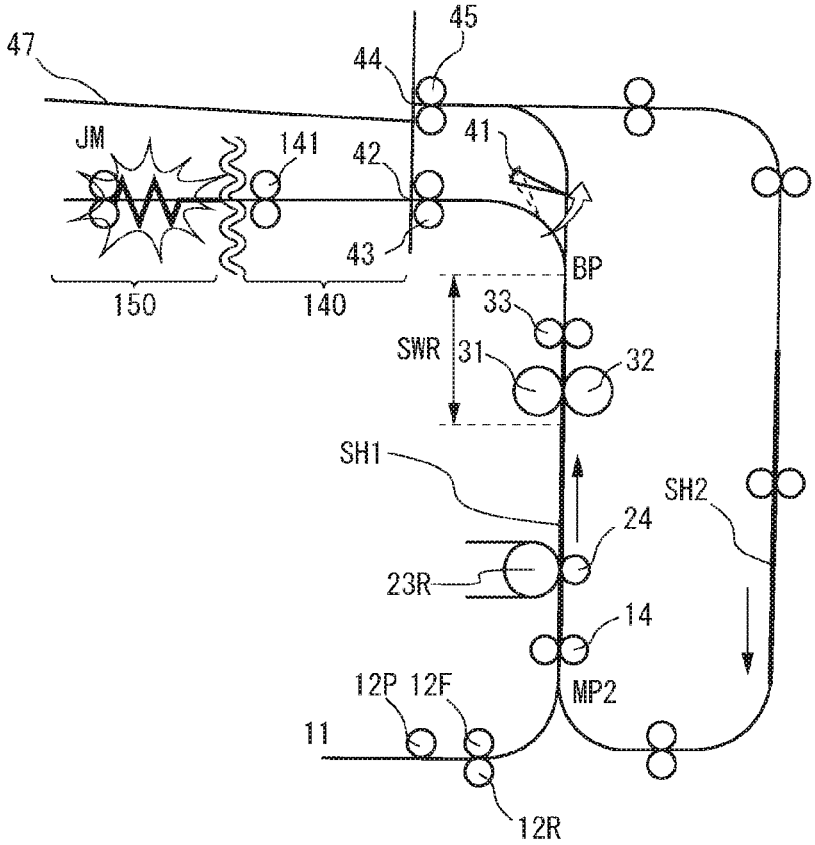
FIGS. 9A and 9B are schematic diagrams illustrating positions of sheets that are purged in a case in which no sheets are present in a reverse slot and a switching claw will not switch in time at the time of detection of a jam in a post-processing device that is a conveyance destination.

FIG. 9A is a schematic diagram illustrating that no sheet is present in the reverse slot 44 and the switching claw 41 will not switch in time upon detection of the jam JM in the post-processing device 150. Referring to FIG. 9A, both sheets SH1, SH2 that are being conveyed are targets for duplex printing. At the time of detection of the jam JM, the first sheet SH1 is being printed on its reverse side and the second sheet SH2 is being conveyed on the return path 48 after it is printed on its front side and reverses its direction of motion at the reverse slot 44. At the time of detection, the conveyance destination of the first sheet SH1 at the branch point BP is the ejection slot 42, and therefore the switching claw 41 raises its tip and forms the outlet path. After the purge controller 402 refers to the sheet position data 421 to check that no sheet is present at the reverse slot 44 at the time of detection of the jam JM, the purge controller 402 further checks whether the switching claw 41 can switch the conveyance destination of the first sheet SH1 from the outlet path to the reverse slot 44.

More specifically, the purge controller 402 determines that if the leading end of the first sheet SH1 is at a distance of a threshold value SWR from the branch point BP at the time of detection of the jam JM, the switching claw 41 can switch the conveyance destination of the sheet SH1. The threshold value SWR is, at least, equal to a distance over which the conveyance unit 410 conveys a sheet while the switching claw 41 switches the conveyance destination from the outlet path to the reverse slot 44 or vice versa.

FIG. 9A indicates the distance of the threshold value SWR upstream from the branch point BP. If the leading end of the first sheet SH1 at the time of detection of the jam JM were positioned farther from the branch point BP than the distance represented by the threshold value SWR, the conveyance unit 410 could lower the tip of the switching claw 41 to form the reverse path by the time the first sheet SH1 arrives at the branch point BP. Accordingly, the purge controller 402 made the conveyance unit 410 lower the tip of the switching claw 41 to switch the conveyance destination of the first sheet SH1 to the reverse slot 44, to purge the first sheet SH1 to the reverse tray 47.

In the example illustrated in FIG. 9A, the leading end of the first sheet SH1 is closer to the branch point BP than the distance indicated by the threshold value SWR at the time of detection of the jam JM. Accordingly, the purge controller 402 determines that the switching claw 41 cannot switch the conveyance destination of the sheet SH1.

Figure 9B:
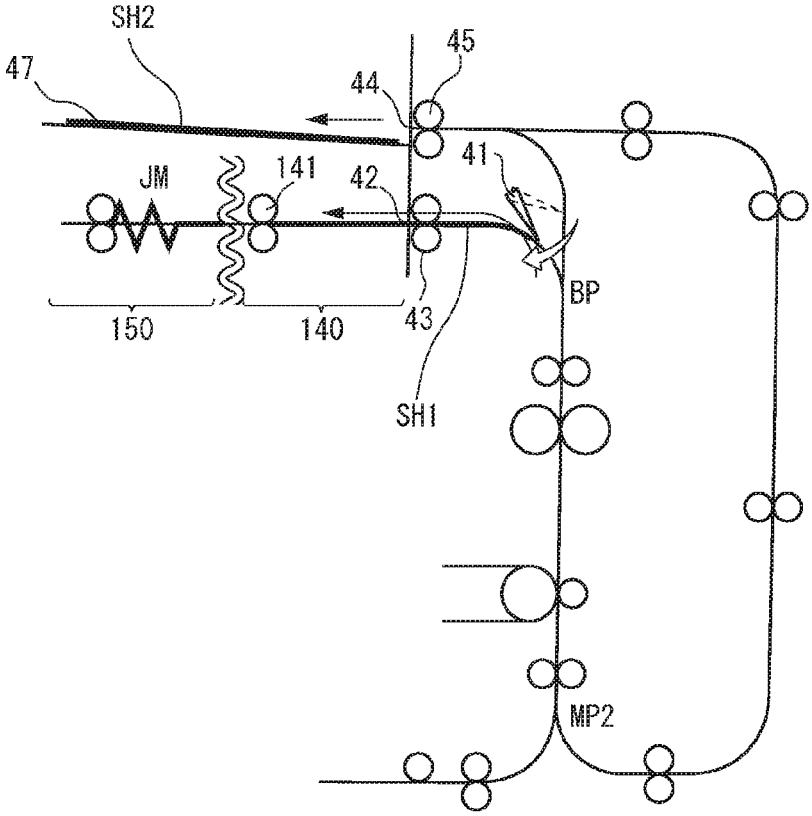

FIG. 9B is a schematic diagram illustrating positions of the sheets SH1, SH2 during purge in the case shown in FIG. 9A. Referring to FIG. 9B, the purge controller 402 makes the conveyance unit 410 initially keep the tip of the switching claw raised. Thus, the first sheet SH1, which arrives at the branch point BP first, proceeds to the outlet path, which is its original destination, and is conveyed by the ejection roller 43 from the ejection slot 42 to the relay unit 140. The purge controller 402 transmits a stop signal to the post-processing device 150 so that it stops rotating of the conveyance roller 141 of the relay unit 140. Thus, the first sheet SH1, which is delivered out from the ejection slot 42, stops with its leading end in contact with the conveyance roller 141. At a timing of the trailing end of the first sheet SH1 completely passing through the branch point BP, the purge controller 402 makes the conveyance unit 410 lower the tip of the switching claw 41 to form the reverse path. Subsequently, the second sheet SH2 passes from the return path 48 through the second merge point MP2 and arrives at the branch point BP. From the branch point BP the second sheet SH2 proceeds to the reverse tray 47 and is purged.

Thus, even when no sheet is present in the reverse slot 44 at the time of detection of the jam JM, unless the switching unit 41 can form the reverse path by the time the leading sheet arrives at the branch point BP, the purge controller 402 makes the leading sheet be conveyed to the outlet path. This further decreases the risk of a jam during purge.

(E) The purge controller 402, as shown in FIGS. 7A and 7B, determines that the second condition is satisfied because the third sheet SH3 is present in the reverse slot 44 at the time when the post-processing device 150 detects the jam JM. Regardless of other conditions, the purge controller 402 makes the second sheet SH2, which arrives first at the branch point BP, be conveyed to the outlet path. The purge controller 402, independently of the second condition being satisfied, may make the switching claw 41 switch the conveyance destination of the next sheet to the outlet path when the following condition is satisfied. If another sheet is present in the reverse slot 44, the leading sheet to first arrive at the branch point BP will arrive at the reverse slot 44 before the reverse roller 45 completes conveying the other sheet to the return path 48.

More specifically, the purge controller 402 determines that if a distance between the leading end of the leading sheet and the trailing end of the other sheet is shorter than a threshold value at the time of detection of the jam JM, the leading sheet will arrive at the reverse slot 44 before complete conveyance of the other sheet to the return path 48. The threshold value is at least equal to a distance over which the conveyance unit 410 conveys a sheet while the reverse roller 45 reverses the direction of motion of the other sheet and completes conveying the other sheet to the return path 48.

Figure 10A:
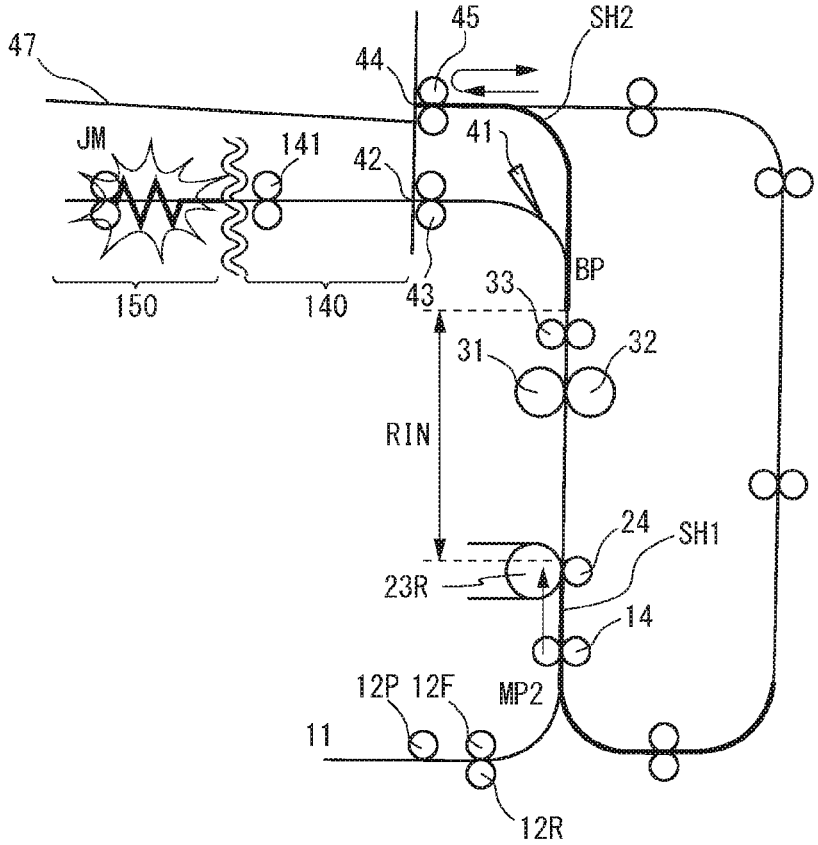
FIGS. 10A and 10B are schematic diagrams illustrating positions of sheets in a case in which a sheet is present in a reverse slot at the time of detection of a jam in a post-processing device that is a conveyance destination, the sheet is returned to a return path, and the next sheet is subsequently purged to the reverse slot.

FIG. 10A is a schematic diagram illustrating positions of first and second sheets in a case. The second sheet SH2 is present in the reverse slot 44 at the time of detection of the jam JM in the post-processing device 150, and after the second sheet SH2 is returned to the return path 48, the first sheet SH1 is purged to the reverse slot 44. Referring to FIG. 10A, both the sheets SH1, SH2 that are being conveyed are targets for duplex printing. At the time of detection of the jam JM, the first sheet SH1 is being printed on its reverse side after it is printed on its front side and reverses its direction of motion at the reverse slot 44, and the second sheet SH2 is reversing its direction of motion at the reverse slot 44 after it is printed on its front side.

At the time the post-processing device 150 detects the jam JM, if a distance RIN from the trailing end of the second sheet SH2 to the leading end of the first sheet SH1 is shorted than the threshold value, the leading end of the first sheet SH1 will arrive at the reverse slot 44 before the second sheet SH2 reverses its direction of motion at the reverse slot 44 and is completely conveyed to the return path 48. Accordingly, purging the first sheet SH1 from the reverse slot 44 has a high risk of the first sheet SH1 coming into contact with the second sheet SH2. In this case, the purge controller 402 makes the conveyance unit 410 raise the tip of the switching claw 41 to convey the first sheet SH1 to the outlet path.

In the example illustrated in FIG. 10A, at the time of detection of the jam JM, the distance RIN from the trailing end of the second sheet SH2 to the leading end of the first sheet SH1 is equal to or greater than the threshold value. In this case, the leading end of the first sheet SH1 will arrive at the reverse slot 44 after the second sheet SH2 is conveyed from the reverse slot 44 to the return path 48. Accordingly, even if the first sheet SH1 is conveyed to the reverse slot 44, the first sheet SH1 has a low risk of coming into contact with the second sheet SH2, and therefore the purge controller 402 makes the conveyance unit 410 convey the first sheet SH1 to the reverse slot 44.

Figure 10B:
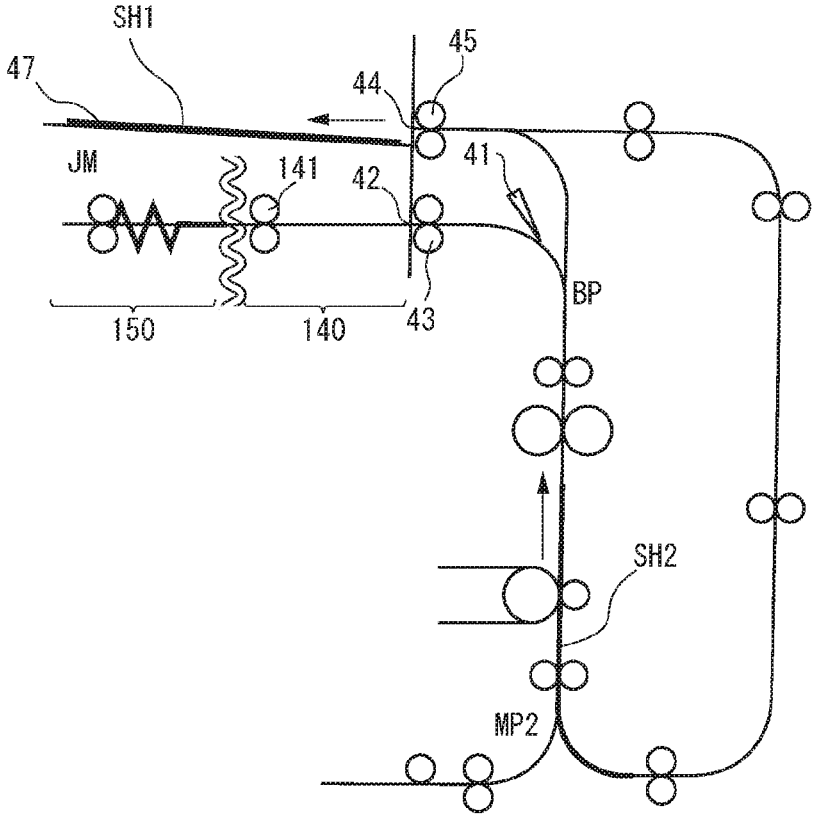

FIG. 10B is a schematic diagram illustrating positions of the sheets SH1, SH2 during the purge in the case shown in FIG. 10A. Referring to FIG. 10B, the purge controller 402 makes the conveyance unit 410 keep the tip of the switching claw lowered. Thus, the conveyance destination from the branch point BP is maintained to be the reverse slot 44 and the first sheet SH1 of the purge targets proceeds to the reverse slot 44 from the branch point BP. The second sheet SH2 passes from the return path 48 through the second merge point MP2 and arrives at the branch point BP. From the branch point BP the second sheet SH2 proceeds to the reverse tray 47 and is purged.

Even when another sheet is present in the reverse slot 44 at the time of detection of the jam JM, the purge controller 402 sets the conveyance destination of the first sheet of the purge targets to the reverse slot 44, as long as the first sheet will arrive at the reverse slot 44 after the reverse roller 45 has completed conveying the other sheet in the reverse slot 44 to the return path 48. Thus, the first sheet can be purged to the reverse tray 47 when it has no need to be conveyed to the outlet path. This frees a user from burden of removing the first sheet from the outlet path.

(F) Sequence of Purge in Modifications (C) and (D).

Figure 11:
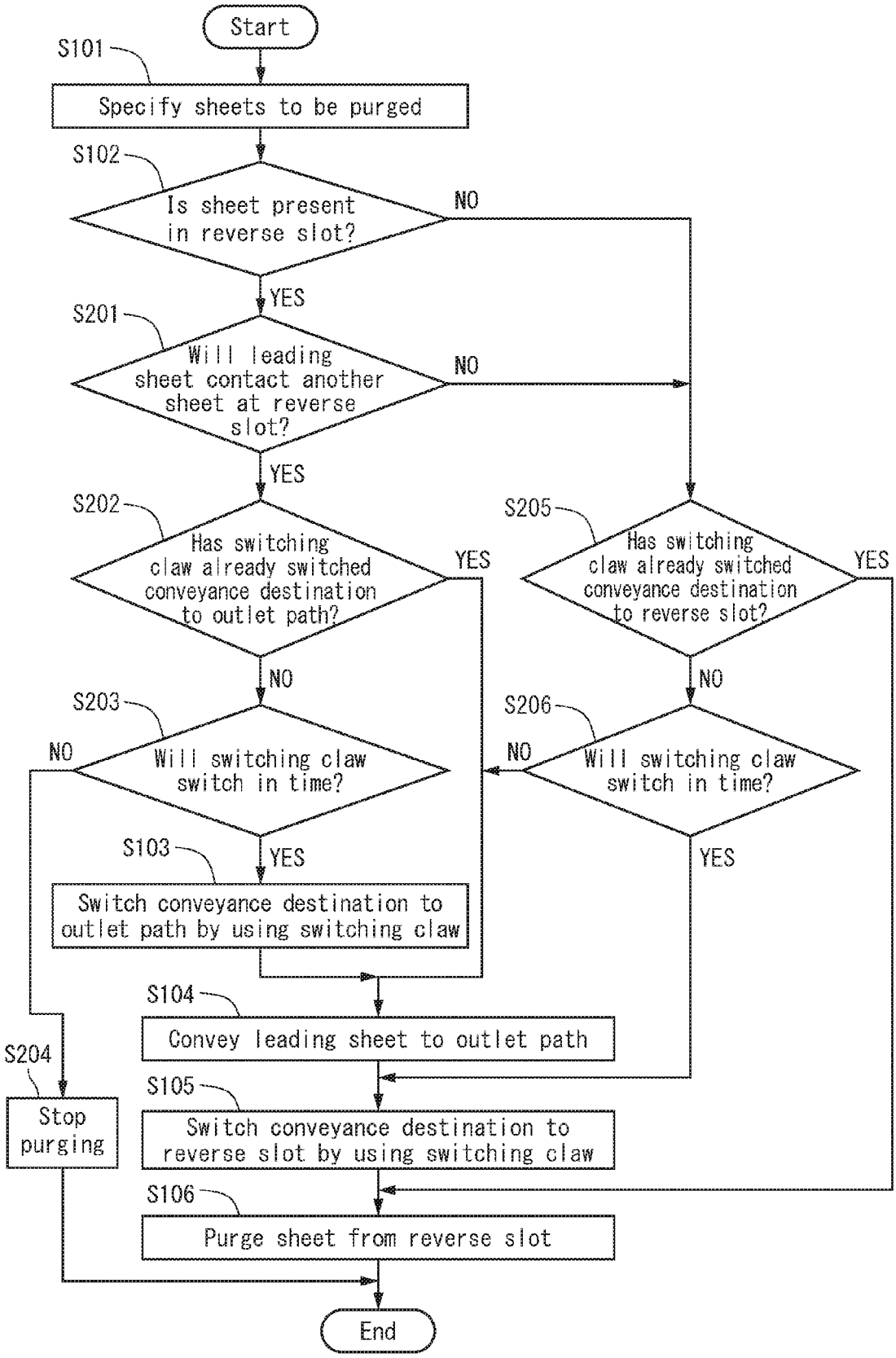
FIG. 11 is a flowchart of the purge illustrated in FIGS. 9A, 9B, 10A, and 10B.

FIG. 11 is a flowchart of the purge illustrated in FIGS. 9A, 9B, 10A, and 10B. In this processing, only steps S201, S202, S203, S204, S205, and S206 after step S102 are different from the processing shown in FIG. 8 and other steps are the same as in FIG. 8. Accordingly, details of only steps S201 to S206 are described below, and details of other steps can be found in the description referring to FIG. 8.

In step S101, the purge controller 402 specifies positions of sheets being conveyed, based on the sheet position data 421, and specifies sheets to be purged that can be conveyed from their current positions to the reverse tray 47. Subsequently, processing proceeds to step S102.

In step S102, the purge controller 402 checks whether or not a sheet is present in the reverse slot 44 at the time of detection of the jam JM. If the sheet is present, processing proceeds to step S201, and if not, to step S205.

In step S201, a sheet is present in the reverse slot 44 at the time of detection of the jam JM. Accordingly, the purge controller 402 further determines whether the first sheet of the purge targets will arrive at the reverse slot 44 before the other sheet present in the reverse slot 44 is completely conveyed to the return path 48. More specifically, the purge controller 402 determines whether or not a distance from the trailing end of the other sheet in the reverse slot 44 to the leading end of the first sheet is less than the threshold value at the time of detection of jam JM. If the distance is less than the threshold value, processing proceeds to step S202, and if the distance is greater than or equal to the threshold value, to step S205.

In step S202, the other sheet is present in the reverse slot 44 at the time of detection of the jam JM, and the first sheet of the purge targets is at a position that could arrive at the reverse slot 44 before the reverse roller 45 completes conveyance of the other sheet in the reverse slot 44 to the return path 48. More specifically, the distance from the trailing end of the other sheet in the reverse slot 44 to the leading end of the first sheet is shorter than the threshold value at the time of detection of the jam JM. Accordingly, the first sheet cannot be purged to the reverse slot 44, and therefore the purge controller 402 checks whether or not the switching claw 41 has already switched the conveyance destination from the branch point BP to the outlet path. If the switching claw 41 has, processing proceeds to step S104, and if not, to step S203.

In step S203, the switching claw 41 has not yet switched the conveyance destination from the branch point BP to the outlet path. As illustrated in FIG. 10A, the sheet to first arrive at the branch point BP after the time of detection of the jam JM is the first sheet SH1 that is heading towards the ejection slot 42 after it is printed on its reverse side, unlike the sheet SH2 that has just passed through the branch point BP. This situation may occur depending on the timing of detection of the jam JM. In this situation, the purge controller 402 determines whether or not the switching claw 41 can switch the conveyance destination of the first sheet before it reaches the branch point BP. More specifically, the purge controller 402 checks whether or not the leading end of the first sheet is at a distance equal to or greater than the threshold value SWR upstream from the branch point BP. If the switching claw 41 can switch, processing proceeds to step S103, and if not, to step S204.

In step S204, the switching claw 41 cannot switch the conveyance destination of the first sheet to the outlet path before the first sheet reaches the branch point BP. Accordingly, the purge controller 402 stops the continuance of conveyance of sheets by the conveyance unit 410, cancelling purge. Subsequently, processing ends.

In step S103, the other sheet is present in the reverse slot 44 at the time of detection of the jam JM, and before it is completely conveyed to the return path 48, the first sheet will arrive at the reverse slot 44. However, at the time of detection of the jam JM, the first sheet is at least the threshold value SWR distant from the branch point BP. Accordingly, the purge controller 402 makes the conveyance unit 410 raise the tip of the switching claw 41 so that the conveyance destination of the first sheet is switched to the outlet path. The purge controller 402 also transmits a stop signal to the post-processing device 150 so that it stops rotating of the conveyance roller 141 of the relay unit 140. Subsequently, processing proceeds to step S104.

In step S205, no sheet is present in the reverse slot 44 at the time of detection of the jam JM. Alternatively, the other sheet is present, but the first sheet is at a position from which it will arrive at the reverse slot 44 only after the reverse roller 45 completes conveying the other sheet in the reverse slot 44 to the return path 48. More specifically, a distance from the trailing end of the other sheet in the reverse slot 44 to the leading end of the first sheet is greater than or equal to a threshold value at the time of detection of jam JM. Accordingly, the purge controller 402 checks whether or not the switching claw 41 has already switched the conveyance destination from the branch point BP to the reverse slot 44. If the switching claw 41 has, processing proceeds to step S106, and if not, to step S206.

In step S206, the switching claw 41 has not yet switched to the reverse slot 44 the conveyance destination from the branch point BP. Accordingly, the purge controller 402 determines whether or not the switching claw 41 can switch the conveyance destination of the first sheet before it reaches the branch point BP. More specifically, the purge controller 402 checks whether or not the leading end of the first sheet is at a distance equal to or greater than the threshold value SWR upstream from the branch point BP. If the switching claw 41 can, processing proceeds to step S105, and if not, to step S104.

In step S104, the conveyance unit 410 has already made the switching claw 41 switch the conveyance destination of the first sheet to the outlet path. Alternatively, the first sheet is at a distance less than or equal to the threshold value SWR from the branch point BP, i.e., a distance the conveyance unit 410 cannot make the switching claw 44 switch the conveyance destination of the first sheet to the reverse slot 44 before it reaches the branch point BP. Accordingly, the purge controller 402 makes the conveyance unit 410 keep the tip of the switching claw 41 raised so that the conveyance destination of the first sheet continues to be the outlet path. Thus, the first sheet follows the outlet path and is conveyed to the relay unit 140 from the ejection slot 42. Subsequently, processing proceeds to step S105.

In step S105, the first sheet has already been conveyed to the outlet path. Alternatively, it is possible for the switching claw 41 to switch the conveyance destination of the first sheet to the reverse slot 44 before the first sheet arrives at the branch point BP. Accordingly, the purge controller 402 makes the conveyance unit 410 lower the tip of the switching claw 41 so that the conveyance destination of all sheets subsequently arriving at the branch point BP is switched to the reverse slot 44. Subsequently, processing proceeds to step S106.

In step S106, the purge controller 402 makes the conveyance unit 410 continue to convey sheets that are purge targets. Thus, subsequently, all sheets arriving at the branch point BP are purged to the reverse tray 47. Subsequently, processing ends.

In the flowchart of FIG. 11, after checking whether or not a sheet is present in the reverse slot 44 at the time of detection of the jam JM in step S102, the purge controller 402 checks whether or not the switching claw 41 can switch the conveyance destination of the first sheet by the time it arrives at the branch point BP. Furthermore, the purge controller 402 may first check whether or not the switching claw 41 can switch before the first sheet arrives at the branch point BP, and only when the switching claw 41 can, may check whether or not another sheet is present in the reverse slot 44. When the switching claw 44 cannot switch in time, then regardless of whether or not another sheet is present in the reverse slot 44, the first sheet is conveyed to the outlet path. This also decreases the risk of a jam during purge.

Figure 12:
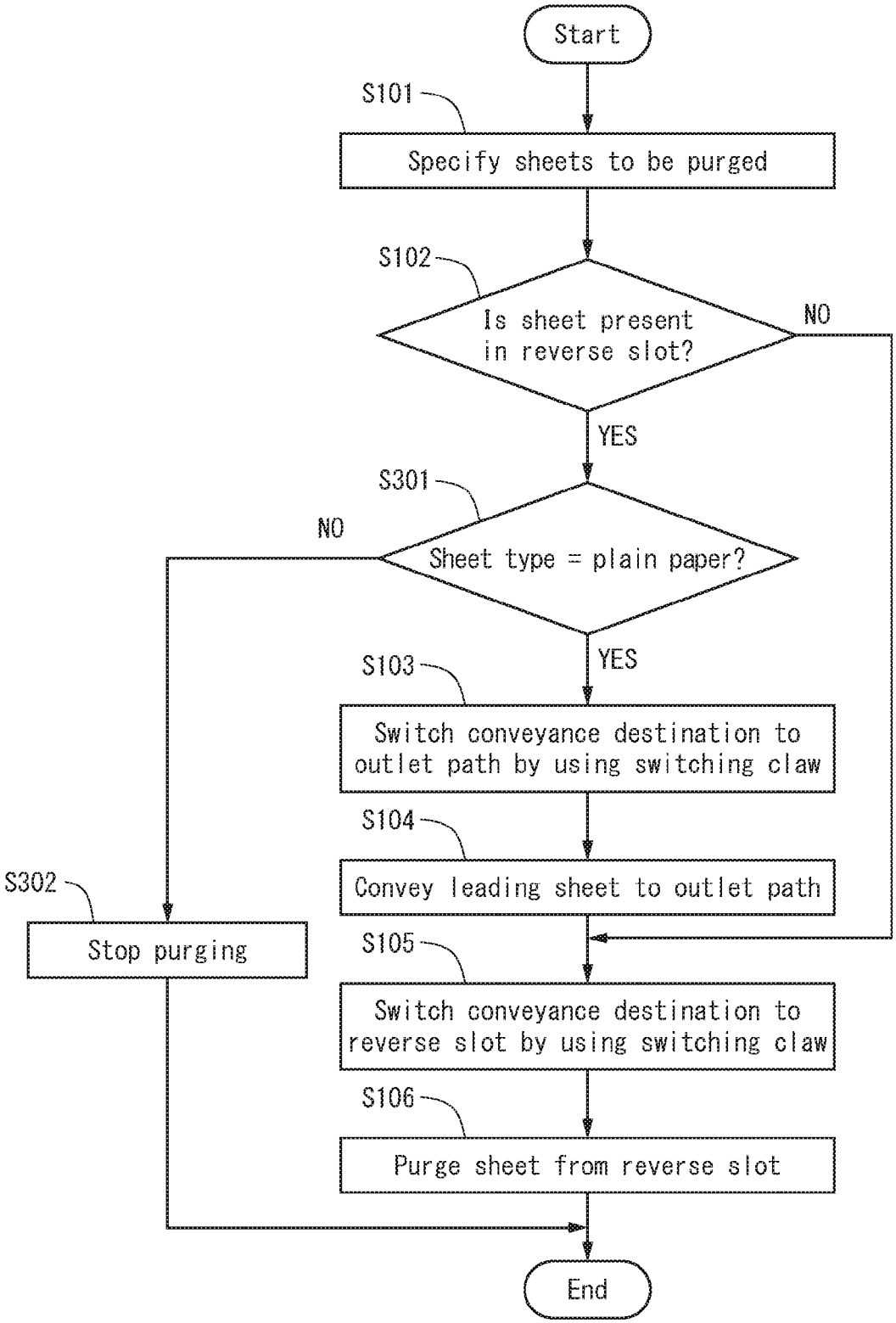
FIG. 12 is a flowchart of a modification of purge according to Embodiment 1 of the invention.

(G) In the purge according to Embodiment 1, as illustrated in FIG. 8, the second condition is satisfied when a sheet is present in the reverse slot 44 at the time of detection of a jam, and therefore the purge controller 402 makes the leading sheet to first arrive at the branch point BP be conveyed to the outlet path. The purge controller 402 may, even when the second condition is satisfied, cancel purge unless the leading sheet is classified as plain paper. A sheet of a type other than plain paper may be classified as high quality, coated, etc., i.e., a type that is greatly reduced in printing quality when slightly folded or damaged, or which cannot easily be discarded because it has a higher value than plain paper. Both conveying a sheet to the outlet path and removing a sheet therefrom by hand have a high risk of damaging the sheet. Accordingly, cancelling purge unless the leading sheet is classified as plain paper decreases the risk of damaging the leading sheet by conveying it to the outlet path. FIG. 12 is a flowchart of purge according to this modification. In this processing, only steps S301 and S302 after step S102 are different from the processing shown in FIG. 8 and other steps are the same as in FIG. 8. Accordingly, details of only steps S301 and S302 are described below, and details of other steps can be found in the description referring to FIG. 8.

In step S101, the purge controller 402 specifies positions of sheets being conveyed, based on the sheet position data 421, and specifies sheets to be purged that can be conveyed from their present positions to the reverse tray 47.

Subsequently, processing proceeds to step S102.

In step S102, the purge controller 402 checks whether or not a sheet is present in the reverse slot 44 at the time of detection of a jam. If a sheet is present in the reverse slot 44 at the time of detection, processing proceeds to step S301, and if otherwise, processing proceeds to step S105.

In step S301, at the time of detection of the jam a sheet is present in the reverse slot 44 and therefore the second condition is satisfied. In this case, the purge controller 402 further checks whether or not the leading sheet to first arrive at the branch point BP after the time of detection is classified as plain paper. The purge controller 402 reads the paper type of the leading sheet from the paper type requested by the printing job. If the leading sheet is classified as plain paper, processing proceeds to step S103, and if not, to step S302.

In step S302, the leading sheet is not classified as plain paper. Accordingly, the purge controller 402 stops the continuance of conveyance of sheets by the conveyance unit 410, cancelling purge. Subsequently, processing ends.

In step S103, a sheet is present in the reverse slot 44 at the time of detection of the jam, and therefore the second condition is satisfied, and the leading sheet is classified as plain paper. Accordingly, after the time of detection, the purge controller 402 makes the conveyance unit 410 switch the conveyance destination of the leading sheet to the outlet path and makes the post-processing unit 150 stop rotation of the conveyance roller 141 of the relay unit 140. Subsequently, processing proceeds to step S104.

In step S104, the purge controller 402 makes the conveyance unit 410 continue to convey sheets that are purge targets. Thus, the leading sheet is conveyed to the outlet path. Subsequently, processing proceeds to step S105.

In step S105, no sheet is present in the reverse slot 44 at the time of detection of the jam, and therefore the first condition is satisfied. Alternatively, when the second condition is satisfied, the leading sheet has already been completely conveyed to the outlet path. Accordingly, the purge controller 402 makes the conveyance unit 410 set the conveyance destination of all sheets subsequently arriving at the branch point BP to the reverse slot 44. Subsequently, processing proceeds to step S106.

In step S106, the purge controller 402 makes the conveyance unit 410 continue to convey sheets that are purge targets. Thus, the leading sheet is either already held on the outlet path or purged to the reverse tray 47, and the second and subsequent sheets are purged to the reverse tray 47. Subsequently, processing ends.

According to this modification, when the second condition is satisfied, the purge controller 402 makes the conveyance unit 410 continue to convey sheets that are purge targets as long as the sheets are classified as plain paper. Alternatively, the purge controller 402 may allow a user to select in advance a paper type of sheets that the purge controller 402 should make the conveyance unit 410 continue to convey and/or a paper type of sheets that the purge controller 402 should make the conveyance unit 410 cancel continuance of conveying.

Embodiment 2

The image forming system according to Embodiment 2 of the invention includes the MFP 100, a relay unit, and the post-processing device 150, as per Embodiment 1. The relay unit has a different conveyance path configuration from the relay unit 140 according to Embodiment 1. Other elements are similar to those described in Embodiment 1. Accordingly, the following describes only differences. Details of similar elements can be found in description of Embodiment 1.

Figure 13:
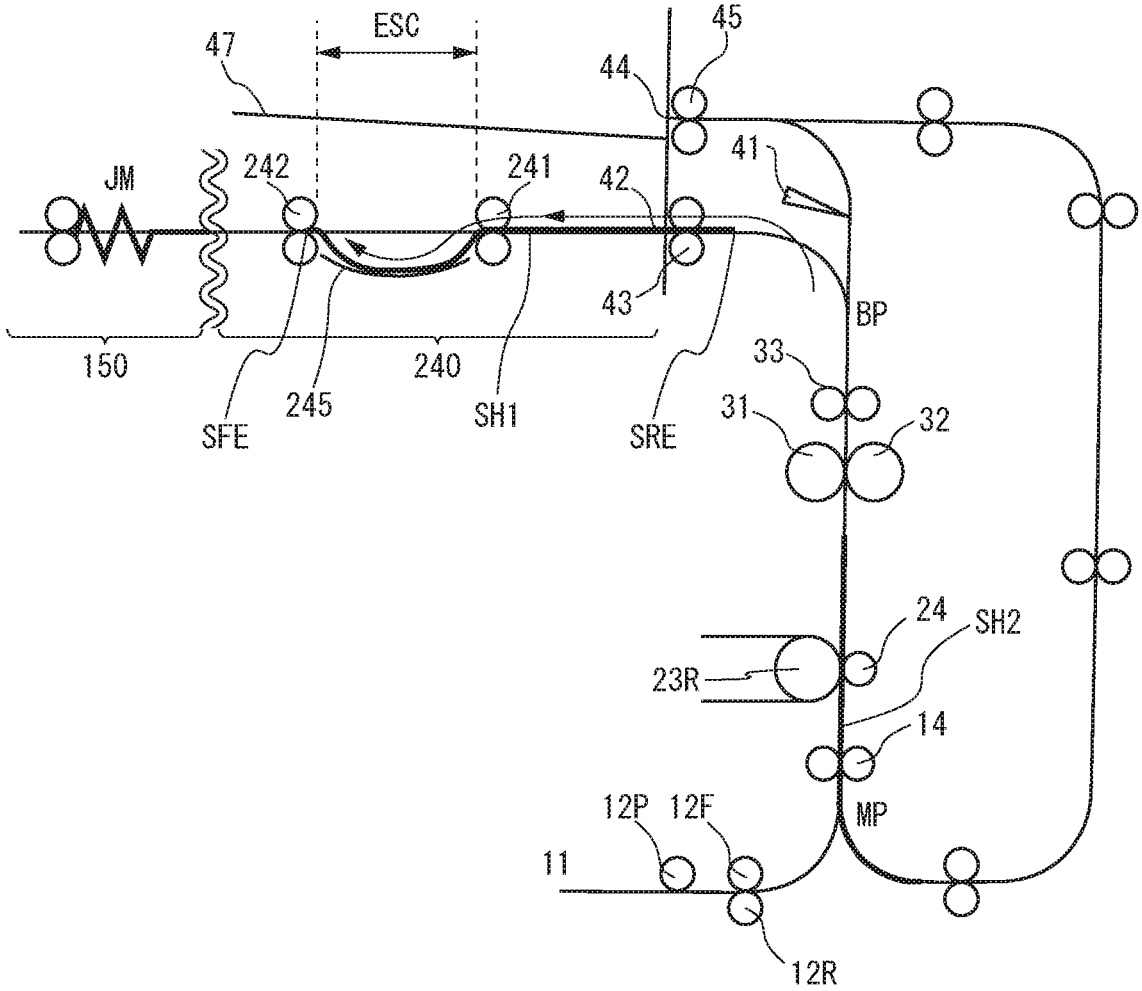
FIG. 13 is a schematic diagram illustrating a position of a sheet held on an outlet path in a case where a switching claw will not switch in time at the time of detection of a jam in a post-processing device that is a conveyance destination in an image forming system according to Embodiment 2 of the invention.

FIG. 13 is a schematic diagram illustrating a portion of a conveyance path of a relay unit 240 according to Embodiment 2, and the position of a first sheet SH1 held on the portion of the conveyance path due to a jam JM in the post-processing device 150. Referring to FIG. 13, the relay unit 240 includes, as a portion of the conveyance path thereof, a siding section ESC between two conveyance rollers 241, 242. The siding section ESC has a guide 245 disposed in the lower side of a space through which a sheet passes between the conveyance rollers 241, 242. The guide 245 has a concave surface that forms a downwards recess When the second condition is satisfied, i.e., when a sheet is present in the reverse slot 44 at the time of detection of the jam JM, the purge controller 402, after the time of detection, makes the conveyance unit 410 raise the tip of the switching claw 41 to switch to the outlet path the conveyance destination of the leading sheet SH1 to first arrive at the branch point BP. Thus, the leading sheet SH1 follows the outlet path from the branch point BP and enters the relay unit 240.

The purge controller 402 transmits a stop signal to the post-processing device 150 so that it stops rotating of the downstream conveyance roller 242 located at the downstream end of the siding section ESC of the relay unit 240. The downstream conveyance roller 242 impedes forward progress of the leading sheet SH1; while the upstream conveyance roller 241 located at the upstream end of the siding section ESC pushes the leading sheet SH1 into the siding section ESC. As a result, the leading sheet SH1 bends along the guide 245 of the siding section ESC with its leading end in contact with the downstream conveyance roller 242.

In this way, the purge controller 402 makes the conveyance roller 241 of the relay unit 240 and the ejection roller 43 push the leading sheet SH1 into the siding section ESC until its portion in the siding section ESC is bent to be in contact with the entirety of the guide 245. Subsequently, the purge controller 402 stops rotating of the conveyance rollers 241, 43 and thereby stops the sheet SH1 with its portion in the siding section ESC greatly bent. This bending enables the trailing end SRE of the sheet SH1 to advance, without creasing the sheet SH1, closer to the downstream conveyance roller 242, at which the leading end SFE of the sheet SH1 stays, than a distance of the actual length of the sheet SH1 from the downstream conveyance roller 242. As a result, the trailing end SRE can more reliably be removed from the branch point BP without damaging the sheet SH1. Thus, subsequent sheets can reliably be purged.

When a sheet to be conveyed into the siding section ESC during purge is larger than a maximum size accommodated by the siding section ESC, even bending the sheet in the siding section ESC as described above may leave a risk that the trailing end of the sheet remains at the branch point BP. In such a case, even conveying the sheet into the siding section ESC may not ensure reliable purging of the next sheet. Accordingly, even when the second condition is satisfied, the purge controller 402 cancels purge if the size of the sheet to be conveyed into the siding section ESC is greater than a threshold value. The threshold value is equal to the size of a sheet whose trailing edge would remain at the branch point BP even if the sheet were bent into the siding section ESC.

Figure 14:
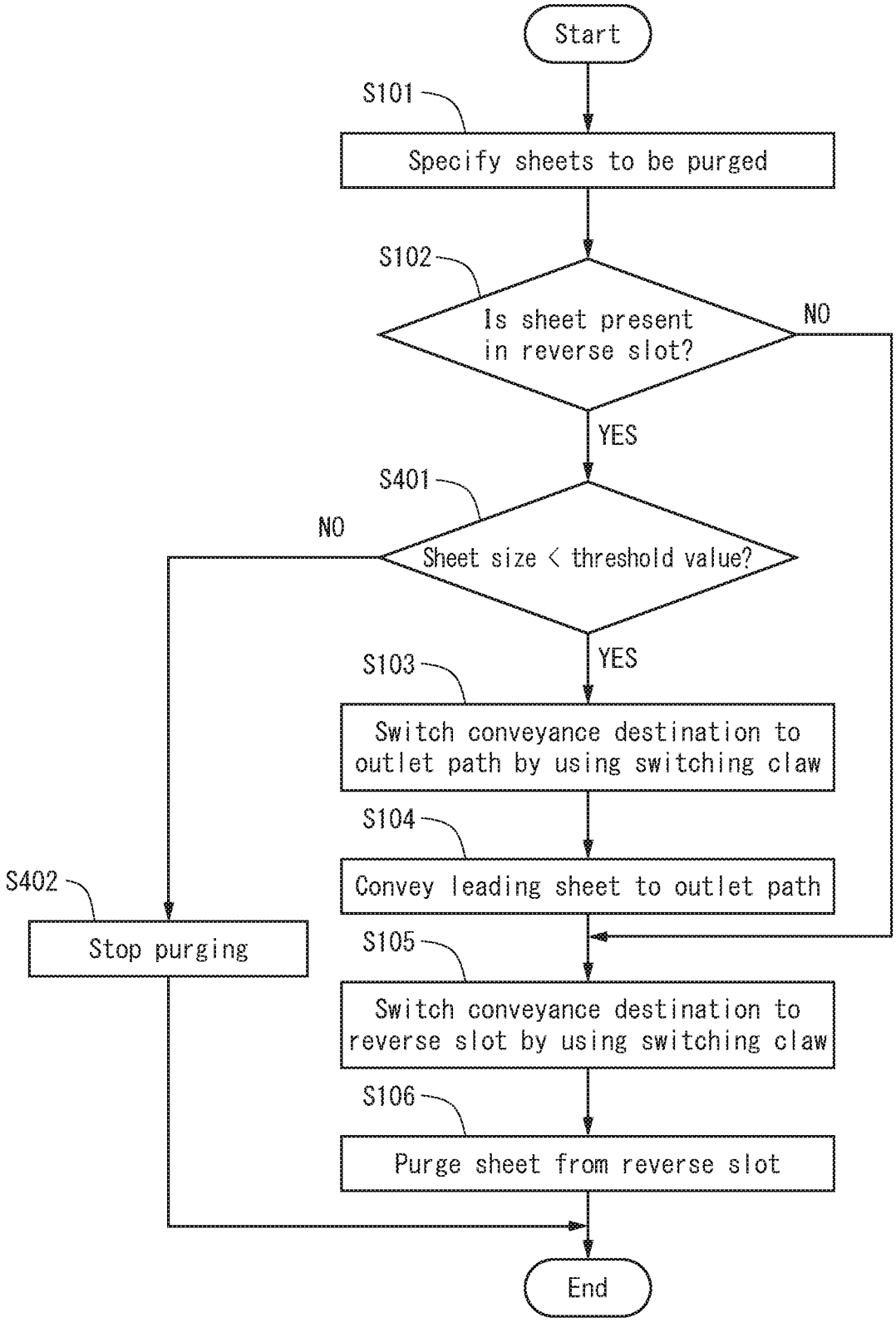
FIG. 14 is a flowchart of purging processing according to Embodiment 2 of the invention.

FIG. 14 is a flowchart of the purge according to Embodiment 2. In this processing, only steps S401 and S402 after step S102 are different from the processing shown in FIG. 8 and other steps are the same as in FIG. 8. Accordingly, details of only the steps S401 and S402 are described below, and details of other steps can be found in the description referring to FIG. 8.

In step S101, the purge controller 402 specifies positions of sheets being conveyed, based on the sheet position data 421, and specifies sheets to be purged that can be conveyed from their current positions to the reverse tray 47. Subsequently, processing proceeds to step S102.

In step S102, the purge controller 402 checks whether or not a sheet is present in the reverse slot 44 at the time of detection of a jam. If the sheet is present, processing proceeds to step S401, and if not, to step S105.

In step S401, at the time of detection of the jam a sheet is present in the reverse slot 44 and therefore the second condition is satisfied. The purge controller 402 further checks whether or not the leading sheet to first arrive at the branch point BP after the time of detection has a size less than the threshold value. The purge controller 402 reads this size from the sheet size requested in the print job or calculates it from the length of time during which the leading sheet passed through the timing sensor TS. If the size is less than the threshold value, processing proceeds to step S103, and if not, to step S402.

In step S402, the size of the leading sheet is greater than or equal to the threshold value. Even if the sheet is bent into the siding section ESC, there is a risk of the trailing end of the sheet remaining at the branch point BP. Accordingly, the purge controller 402 makes the conveyance unit 410 stop continuing to convey sheets, cancelling purge. Subsequently, processing ends.

In step S103, at the time of detection of the jam a sheet is present in the reverse slot 44 and therefore the second condition is satisfied. Accordingly, after the time of detection, the purge controller 402 makes the conveyance unit 410 switch the conveyance destination of the leading sheet to the outlet path, and makes the post-processing unit 150 stop rotation of the conveyance roller 242 of the relay unit 240. Subsequently, processing proceeds to step S104.

In step S104, the purge controller 402 makes the conveyance unit 410 continue to convey sheets that are purge targets. Thus, the leading sheet is conveyed to the outlet path. Subsequently, processing proceeds to step S105.

In step S105, no sheet is present in the reverse slot 44 at the time of detection of the jam, and therefore the first condition is satisfied. Alternatively, when the second condition is satisfied, the leading sheet has already been completely conveyed to the outlet path. Accordingly, the purge controller 402 makes the conveyance unit 410 set the conveyance destination of all sheets subsequently arriving at the branch point BP to the reverse slot 44. Subsequently, processing proceeds to step S106.

In step S106, the purge controller 402 makes the conveyance unit 410 continue to convey sheets that are purge targets. Thus, the leading sheet is either already held on the outlet path or purged to the reverse tray 47, and the second and subsequent sheets are purged to the reverse tray 47. Subsequently, processing ends.

Advantages of Embodiment 2

When the destination device, i.e., the relay unit 240 or the post-processing device 150, detects a jam, the sheet conveyance device according to Embodiment 2 of the invention, like the device 400 according to Embodiment 1, first selects as sheets to be purged, sheets that the device can convey to the reverse tray 47 of the MFP 100 among the sheets that the device is conveying at the time of detection of the jam. The sheet conveyance device subsequently, if the first condition is satisfied, purges from the reverse slot 44 to the reverse tray 47 the leading sheet that first reaches the branch point BP after the detection of the jam, and if the second condition is satisfied, conveys the leading sheet to the outlet path. The first condition is set to be satisfied when no other sheet is present in the reverse slot at the time of detection of the jam. The second condition is set to be satisfied when another sheet is present in the reverse slot at the time of detection of the jam. In this manner, the sheet conveyance device 400 enables the reverse slot 44 to double as a place where sheets are purged while keeping narrow spacing between the sheets conveyed during duplex printing and preventing the sheets being purged from coming into contact with another sheet that is reversing its direction of motion at the reverse slot 44. As a result, the sheet conveyance device can achieve purging without hindering productivity of the image forming system and while reducing the size of its body.

The relay unit 240 in Embodiment 2 includes the siding section ESC, in contrast to the relay unit 140 in Embodiment 1. The siding section ESC has the guide 245 disposed therein. The guide 245 has a concave surface that forms a downwards recess. If the second condition is satisfied, the sheet conveyance device pushes the leading sheet SH1 into the siding section ESC, as shown in FIG. 13, until the portion of the leading sheet SH1 in the siding section ESC bends in contact with the entirety of the top face of the guide 245. This bending enables the trailing end SRE of the sheet SH1 to advance, without creasing the sheet SH1, closer to the downstream conveyance roller 242, at which the leading end SFE of the sheet SH1 stays, than a distance of the actual length of the sheet SH1 from the downstream conveyance roller 242. As a result, the trailing end SRE can more reliably be removed from the branch point BP without damaging the sheet SH1. Thus, subsequent sheets can reliably be purged.

Note that the modifications for Embodiment 1 are also effective for the sheet conveyance device according to Embodiment 2 of the invention.

Supplement

The sheet conveyance device according to the above embodiments of the invention selects a destination for a leading sheet, which is the first sheet to arrive at a downstream end of a conveyance path among sheets that are being conveyed at the time of detection of a jam, the jam being in a device that is a conveyance destination, and the destination being selected according to a first condition and a second condition. When the first condition is satisfied, the leading sheet is purged to the outside of the reverse slot, and when the second condition is satisfied, the leading sheet is conveyed to the outlet path. The first condition is satisfied when no other sheet is present in the reverse slot at the time of detection of the jam, and the second condition is satisfied when another sheet is present in the reverse slot at the time of detection of the jam. Thus, the leading sheet does not come into contact with a sheet that is reversing its direction of motion, and sheets can be purged from the reverse slot.

Based on the above-described embodiments, the invention may be further characterized as follows.

The controller unit may determine that the first condition is satisfied if no other sheet is present in the reverse slot at the time of detection of the jam, regardless of other conditions, and may determine that the second condition is satisfied if another sheet is present in the reverse slot at the time of detection of the jam, regardless of other conditions.

Even if the first condition is satisfied, the controller unit may further require that the switching unit is able to switch a destination of the leading sheet at the time of detection of the jam. Independently of the second condition being satisfied, the controller unit may further require that switching unit is unable to switch a destination of the leading sheet at the time of detection of the jam. The controller unit may determine that the switching unit is able to switch a destination of the leading sheet at the time of detection of the jam if the leading end of the leading sheet is positioned at least a predefined distance upstream of the downstream end of the conveyance path. The minimum value for this distance may be equal to a distance the conveyance unit conveys a sheet while the switching claw switches the conveyance destination from the outlet path to the reverse slot or vice versa.

Independently of the second condition being satisfied, the controller unit may further require that the leading sheet would reach the reverse slot before the reverse unit finishes moving another sheet to the return path in order to set the outlet path as the destination of the leading sheet. The controller unit may further, when controlling the conveyance unit, the reverse unit, and the return unit to continue to convey sheets, control the switching unit to set the reverse slot as the destination of the second sheet and all subsequent sheets that arrive at the downstream end of the conveyance path The controller unit may, when controlling the conveyance unit, the reverse unit, and the return unit to continue to convey sheets, and the leading sheet is to be conveyed to the outlet path, control the switching unit to cancel the continuance of conveying depending on a type of the leading sheet. In particular, the controller unit may permit the conveyance unit, the reverse unit, and the return unit to continue to convey the sheets if the leading sheet is classified as plain paper. The controller unit may allow a user to select a type of the leading sheet from which the controller unit determines whether to permit or cancel the continuance of conveying sheets.

A downstream conveyance device may include a siding section for holding a sheet with a bend, and when the siding section is located upstream from a location where the jam is detected, the downstream conveyances device, in response to a stop signal, conveys the leading sheet to the siding section and bends and stops the leading sheet in the siding section. In this case, the controller unit may set a threshold value to a size of a sheet whose rear edge remains at the downstream end of the conveyance path when the downstream conveyance device bends and stops the sheet in the siding section. When the controller unit controls the conveyance unit, the reverse unit, and the return unit to continue to convey the sheets, and determines that the leading sheet should be conveyed to the outlet path, and determines that the leading sheet as a size equal to or greater than the threshold value, the controller unit may cancel the continuance of conveying.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A sheet conveyance device comprising:

a body including a conveyance path through which a sheet passes, an outlet path connecting the downstream end of the conveyance path to a destination device, a reverse slot that is an opening of the body connected to the downstream end of the conveyance path and where a sheet reverses its direction of motion, and a return path connecting the reverse slot to the conveyance path;

a conveyance unit configured to convey a sheet through the conveyance path;

a switching unit configured to switch, at the downstream end of the conveyance path, a destination of a sheet between the outlet path and the reverse slot;

a delivery unit configured to deliver a sheet from the outlet path to a destination device;

a reverse unit configured to first convey a sheet to a position where a portion of the sheet hangs out of the reverse slot outside the body, and then move the sheet in the reverse direction from the position to the return path;

a return unit configured to convey a sheet through the return path to return the sheet face down to the conveyance path; and a controller unit configured to, when at least one of the conveyance unit, the reverse unit, and the return unit is conveying one or more sheets at the time of detection of a jam in the destination device, control the conveyance unit, the reverse unit, and the return unit to continue to convey the one or more sheets to purge the one or more sheets from the reverse slot to the outside of the body or to convey the one or more sheets to the outlet path, the controller unit further configured to, when controlling the conveyance unit, the reverse unit, and the return unit to continue to convey the one or more sheets, control the switching unit to convey a leading sheet to the reverse slot if a first condition is satisfied, or to convey the leading sheet to the outlet path if a second condition is satisfied, the leading sheet being, of the one or more sheets, a sheet that first reaches the downstream end of the conveyance path, the first condition being satisfied when no other sheet is present in the reverse slot at the time of detection of the jam, and the second condition being satisfied when another sheet is present in the reverse slot at the time of detection of the jam.

2. The sheet conveyance device according to claim 1, wherein if the first condition is satisfied, the controller unit controls the switching unit to convey the leading sheet to the reverse slot regardless of other conditions.

3. The sheet conveyance device according to claim 1, wherein if the second condition is satisfied, the controller unit controls the switching unit to convey the leading sheet to the outlet path regardless of other conditions.

4. The sheet conveyance device according to claim 1, wherein even if the first condition is satisfied, unless a condition is satisfied that the switching unit is able to switch a destination of the leading sheet at the time of detection of the jam, the controller unit controls the switching unit to cancel conveying of the leading sheet to the reverse slot.

5. The sheet conveyance device according to claim 1, wherein independently of the second condition being satisfied, if a condition is satisfied that the switching unit is unable to switch a destination of the leading sheet at the time of detection of the jam, the controller unit controls the switching unit to convey the leading sheet to the outlet path.

6. The sheet conveyance device according to claim 4, wherein, when the front end of the leading sheet is located at an upstream distance or more from the downstream end of the conveyance path at the time of detection of the jam, the controller unit determines that the switching unit is able to switch a destination of the leading sheet, the upstream distance being no less than a distance over which the conveyance unit conveys a sheet while the switching unit switches a destination of the leading sheet from one of the reverse slot and the outlet path to another.

7. The sheet conveyance device according to claim 1, wherein independently of the second condition being satisfied, if a condition is satisfied that the leading sheet would reach the reverse slot before the reverse unit finishes moving another sheet to the return path, the controller unit controls the switching unit to convey the leading sheet to the outlet path.

8. The sheet conveyance device according to claim 1, wherein the controller unit, when controlling the conveyance unit, the reverse unit, and the return unit to continue to convey the one or more sheets, controls the switching unit to select the reverse slot as the destination of a part of the one or more sheets, the part consisting of the next leading sheet and the following sheets that reach the downstream end of the conveyance path.

9. The sheet conveyance device according to claim 1, wherein when the controller unit controls the conveyance unit, the reverse unit, and the return unit to continue to convey the one or more sheets and determines that the switching unit should be controlled to convey the leading sheet to the outlet path, the controller unit cancels the continuance of conveying depending on a type of the leading sheet.

10. The sheet conveyance device according to claim 9, wherein the controller unit, if the leading sheet is plain paper, permits the conveyance unit, the reverse unit, and the return unit to continue to convey the one or more sheets.

11. The sheet conveyance device according to claim 10, wherein the controller unit allows a user to select a type of the leading sheet from which the controller unit determines whether to permit or cancel the continuance of conveying the one or more sheets.

12. A sheet conveyance system comprising:

a sheet conveyance device including:

a body including a conveyance path through which a sheet passes, an outlet path through which a sheet is sent from the downstream end of the conveyance path, a reverse slot that is an opening of the body connected to the downstream end of the conveyance path and where a sheet reverses its direction of motion, and a return path connecting the reverse slot to the conveyance path;

a conveyance unit configured to convey a sheet through the conveyance path;

a switching unit configured to switch, at the downstream end of the conveyance path, a destination of a sheet between the outlet path and the reverse slot;

a delivery unit configured to deliver a sheet from the outlet path;

a reverse unit configured to first convey a sheet to a position where a portion of the sheet hangs out of the reverse slot outside the body, and then move the sheet in the reverse direction from the position to the return path;

a return unit configured to convey a sheet through the return path to return the sheet face down to the conveyance path; and a controller unit configured to, when at least one of the conveyance unit, the reverse unit, and the return unit is conveying one or more sheets at the time of notification of a jam, control the conveyance unit, the reverse unit, and the return unit to continue to convey the one or more sheets to purge the one or more sheets from the reverse slot to the outside of the body or to convey the one or more sheets to the outlet path, the controller unit further configured to, when controlling the conveyance unit, the reverse unit, and the return unit to continue to convey the one or more sheets, control the switching unit to convey a leading sheet to the reverse slot if a first condition is satisfied, or to convey the leading sheet to the outlet path and issue a stop signal if a second condition is satisfied, the leading sheet being, of the one or more sheets, a sheet that first reaches the downstream end of the conveyance path, the first condition being satisfied when no other sheet is present in the reverse slot at the time of detection of the jam, and the second condition being satisfied when another sheet is present in the reverse slot at the time of detection of the jam;

and a downstream conveyance device configured to convey a sheet from the outlet path to a destination through a path, and when detecting a jam on the path, to notify the controller unit of the jam, and in response to the stop signal, to stop the leading sheet upstream from a location where the jam is detected.

13. The sheet conveyance system according to claim 12, wherein the downstream conveyance device includes a siding section where a sheet is held with a bend, and when the siding section is located upstream from a location where the jam is detected, the downstream conveyance device in response to the stop signal conveys the leading sheet to the siding section and bends and stops the leading sheet in the siding section.

14. The sheet conveyance system according to claim 13, wherein the controller unit:

sets a threshold value to the size of a sheet whose trailing end remains at the downstream end of the conveyance path when the downstream conveyance device bends and stops the sheet in the siding section; and when the controller unit controls the conveyance unit, the reverse unit, and the return unit to continue to convey the one or more sheets, and determines that the switching unit should be controlled to convey the leading sheet to the outlet path, and the leading sheet has a size equal to the threshold value or more, then the controller unit cancels the continuance of conveying.

15. An image forming device comprising:

an image forming unit configured to form an image on a sheet;

and a sheet conveyance device including:

a body including a conveyance path through which the sheet passes from the image forming unit to a destination device, an outlet path through which a sheet is sent from the downstream end of the conveyance path, a reverse slot that is an opening of the body connected to the downstream end of the conveyance path and where a sheet reverses its direction of motion, and a return path connecting the reverse slot to the conveyance path;

a conveyance unit configured to convey a sheet through the conveyance path;

a switching unit configured to switch, at the downstream end of the conveyance path, a destination of a sheet between the outlet path and the reverse slot;

a delivery unit configured to deliver a sheet from the outlet path;

a reverse unit configured to first convey a sheet to a position where a portion of the sheet hangs out of the reverse slot outside the body, and then move the sheet in the reverse direction from the position to the return path;

a return unit configured to convey a sheet through the return path to return the sheet face down to the image forming unit; and a controller unit configured to, when at least one of the conveyance unit, the reverse unit, and the return unit is conveying one or more sheets at the time of detection of a jam, control the conveyance unit, the reverse unit, and the return unit to continue to convey the one or more sheets to purge the one or more sheets from the reverse slot to the outside of the body or to convey the one or more sheets to the outlet path, the controller unit further configured to, when controlling the conveyance unit, the reverse unit, and the return unit to continue to convey the one or more sheets, control the switching unit to convey a leading sheet to the reverse slot if a first condition is satisfied, or to eject the leading sheet to the outlet path if a second condition is satisfied, the leading sheet being, of the one or more sheets, a sheet that first reaches the downstream end of the conveyance path, the first condition being satisfied when no other sheet is present in the reverse slot at the time of detection of the jam, and the second condition being satisfied when another sheet is present in the reverse slot at the time of detection of the jam.

16. An image forming system comprising:

an image forming unit configured to form an image on a sheet;

a sheet conveyance device including:

a body including a conveyance path through which a sheet passes from the image forming unit, an outlet path through which a sheet is sent from the downstream end of the conveyance path, a reverse slot that is an opening of the body connected to the downstream end of the conveyance path and where a sheet reverses its direction of motion, and a return path connecting the reverse slot to the conveyance path;

a conveyance unit configured to convey a sheet through the conveyance path;

a switching unit configured to switch, at the downstream end of the conveyance path, a destination of a sheet between the outlet path and the reverse slot;

a delivery unit configured to deliver a sheet from the outlet path;

a reverse unit configured to first convey a sheet to a position where a portion of the sheet hangs out of the reverse slot outside the body, and then move the sheet in the reverse direction from the position to the return path;

a return unit configured to convey a sheet through the return path to return the sheet face down to the image forming unit; and a controller unit configured to, when at least one of the conveyance unit, the reverse unit, and the return unit is conveying one or more sheets at the time of notification of a jam, control the conveyance unit, the reverse unit, and the return unit to continue to convey the one or more sheets to purge the one or more sheets from the reverse slot to the outside of the body or to convey the one or more sheets to the outlet path, the controller unit further configured to, when controls the conveyance unit, the reverse unit, and the return unit to continue to convey the one or more sheets, control the switching unit to convey a leading sheet to the reverse slot if a first condition is satisfied, or to eject the leading sheet to the outlet path and issue a stop signal if a second condition is satisfied, the leading sheet being, of the one or more sheets, a sheet that first reaches the downstream end of the conveyance path, the first condition being satisfied when no other sheet is present in the reverse slot at the time of detection of the jam, and the second condition being satisfied when another sheet is present in the reverse slot at the time of detection of the jam;

and a post-processing device configured to convey a sheet from the outlet path through a path, and to post process the sheet, the post-processing device further configured to, when detecting a jam on the path, notify the controller unit of the jam, and in response to the stop signal, stop the leading sheet upstream from a location where the jam is detected.

* * * * *